US008098226B2

(12) United States Patent
Yokoyama et al.

(10) Patent No.: US 8,098,226 B2
(45) Date of Patent: Jan. 17, 2012

(54) DRIVE CIRCUIT OF DISPLAY APPARATUS, PULSE GENERATION METHOD, DISPLAY APPARATUS

(75) Inventors: Makoto Yokoyama, Mie (JP); Hajime Washio, Oxford (GB); Yuhichiroh Murakami, Mie (JP); Hiroyuki Adachi, Tokyo (JP); Kenji Hyodo, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 1075 days.

(21) Appl. No.: 11/921,651

(22) PCT Filed: Jun. 12, 2006

(86) PCT No.: PCT/JP2006/311734

§ 371 (c)(1),
(2), (4) Date: Dec. 6, 2007

(87) PCT Pub. No.: WO2006/134861

PCT Pub. Date: Dec. 21, 2006

(65) Prior Publication Data

US 2009/0115758 A1 May 7, 2009

(30) Foreign Application Priority Data

Jun. 14, 2005 (JP) ..... 2005-174386

(51) Int. Cl.
*G09G 3/36* (2006.01)

(52) U.S. Cl. ..... 345/100; 377/64; 345/204; 345/208

(58) Field of Classification Search ..... 345/1.1–111, 345/204–215, 690–699; 377/64–81
See application file for complete search history.

(56) References Cited

U.S. PATENT DOCUMENTS

| | | | | |
|---|---|---|---|---|
| 5,686,936 | A | 11/1997 | Maekawa et al. | |
| 5,818,412 | A * | 10/1998 | Maekawa | 345/100 |
| 5,959,600 | A * | 9/1999 | Uchino et al. | 345/94 |
| 6,023,260 | A * | 2/2000 | Higashi | 345/100 |
| 6,307,681 | B1 * | 10/2001 | Aoki et al. | 359/645 |
| 6,337,677 | B1 * | 1/2002 | Higashi | 345/100 |
| 6,496,169 | B1 * | 12/2002 | Mametsuka | 345/87 |
| 6,724,361 | B1 * | 4/2004 | Washio et al. | 345/98 |
| 7,050,034 | B2 * | 5/2006 | Uchino et al. | 345/99 |
| 7,057,598 | B2 * | 6/2006 | Azami et al. | 345/100 |
| 7,187,356 | B2 * | 3/2007 | Koyama et al. | 345/98 |
| 7,358,950 | B2 * | 4/2008 | Yamashita et al. | 345/98 |
| 7,652,652 | B2 * | 1/2010 | Maeda et al. | 345/100 |

(Continued)

FOREIGN PATENT DOCUMENTS

JP 62-043623 2/1987

(Continued)

*Primary Examiner* — Lun-Yi Lao
*Assistant Examiner* — Gene W Lee
(74) *Attorney, Agent, or Firm* — Harness, Dickey & Pierce, P.L.C.

(57) ABSTRACT

The subject invention provides a drive circuit for a display apparatus, comprising: a shift register; and a pulse generation circuit for generating a drive pulse signal using an output pulse signal generated in the shift register, wherein: the pulse generation circuit forms a pulse-starting edge and a pulse-termination edge of the drive pulse signal using a rise or a fall of pulse resulting from activation of the output pulse signal. On this account, pulse generation can be performed with high accuracy in a pulse generation circuit used for a drive circuit for a display apparatus or the like.

19 Claims, 22 Drawing Sheets

U.S. PATENT DOCUMENTS

| | | | | |
|---|---|---|---|---|
| 7,659,877 | B2 * | 2/2010 | Murakami et al. | 345/100 |
| 7,843,221 | B2 * | 11/2010 | Jinta | 326/68 |
| 7,978,169 | B2 * | 7/2011 | Yamashita et al. | 345/100 |
| 2001/0022573 | A1 * | 9/2001 | Sasaki et al. | 345/100 |
| 2002/0057251 | A1 * | 5/2002 | Higashi | 345/100 |
| 2002/0149558 | A1 * | 10/2002 | Kashima et al. | 345/100 |
| 2003/0231734 | A1 * | 12/2003 | Fujita et al. | 377/64 |
| 2004/0012555 | A1 * | 1/2004 | Yamashita et al. | 345/100 |
| 2004/0104882 | A1 * | 6/2004 | Kitani et al. | 345/100 |
| 2004/0169623 | A1 * | 9/2004 | Fujita | 345/76 |
| 2004/0201563 | A1 * | 10/2004 | Kobayashi | 345/100 |
| 2004/0222981 | A1 * | 11/2004 | Kobayashi et al. | 345/204 |
| 2005/0083292 | A1 * | 4/2005 | Moon et al. | 345/100 |
| 2005/0179635 | A1 * | 8/2005 | Murakami et al. | 345/100 |
| 2005/0195150 | A1 * | 9/2005 | Etoh et al. | 345/100 |
| 2006/0033696 | A1 * | 2/2006 | Nakamura et al. | 345/100 |
| 2006/0232543 | A1 * | 10/2006 | Kobayashi et al. | 345/100 |
| 2007/0030239 | A1 * | 2/2007 | Guo et al. | 345/100 |
| 2008/0012816 | A1 * | 1/2008 | Moon | 345/100 |

FOREIGN PATENT DOCUMENTS

| | | |
|---|---|---|
| JP | 07-295520 | 11/1995 |
| JP | 09-097037 | 4/1997 |
| JP | 10-228262 | 8/1998 |
| JP | 2000-206491 | 7/2000 |
| JP | 2002-162945 | 6/2002 |
| JP | 2004-77546 | 3/2004 |
| WO | WO 2006/040977 | 4/2006 |

* cited by examiner

SCK
SCKB
Q(i-2)
SRa
SRb
SRc
SRd
2
4
(i-1)-th
i-th
(i+1)-th
(i+2)-th
LSa
LSb
LSc
LSd
SR-FFa
SR-FFb
SR-FFc
SR-FFd
CK
CKB
EN
OUTB
SB
QB
R
Q
5
6
7
8
18s
19s
18p
19p
20
30
SAMPLING SWITCH BLOCK 102
104
105
106
107
188
120
30
SRa
SRb
SRc
SCK
SCKB
Q(i-2)
(i-1)-th
i-th
(i+1)-th
NADa
NADb
NADc
INVa
INVb
INVc
LSa
LSb
LSc
SR-FFa
SR-FFb
SR-FFc
LSx
LSy
Bup
118p
119p
118s
119s
SAMPLING SWITCH BLOCK

DRIVE CIRCUIT OF DISPLAY APPARATUS, PULSE GENERATION METHOD, DISPLAY APPARATUS

TECHNICAL FIELD

The present invention relates to a pulse processing circuit typically used for a driver (drive circuit) for driving a display apparatus.

BACKGROUND ART

FIG. 21 shows a structure of a conventional source driver provided in a driver of a display apparatus. As shown in the figure, the source driver 902 includes a shift register 904, a pulse processing circuit 905, and a buffer 920. The shift register 904 includes a large number of shift register stages (circuits) SR. Among them, an (i−1)-th shift register circuit SRa, an i-th shift register circuit SRb, (i+1)-th shift register circuit SRc, and an (i+2)-th shift register circuit SRd are discussed here. Each shift register circuit SR includes a flip-flop SR-FF and a level shifter LS. The level shifter LS serves to carry out level shift of clocks (SCK and SCKB), which are fetched when the EN terminal is active, and outputs the results through an OUTB. The flip-flop SR-FF is a set-reset type flip-flop having an input SB (set bar), a reset R, and outputs Q and QB. For example, the shift register circuit SRa includes a level shifter LSa and a flip-flop SR-FFa, a shift register circuit SRb includes a level shifter LSb and a flip-flop SR-FFb, a shift register circuit SRc includes a level shifter LSc and a flip-flop SR-FFc, and a shift register circuit SRd includes a level shifter LSd and a flip-flop SR-FFd.

An i-th shift register circuit SR is connected to the OUTB of a level shifter LS in the same stage via its SB, and connected to the Q of the (i+2)-th shift register circuit SR (the second adjacent shift register circuit to the right of the figure) via its R, and also connected to an EN terminal of a level shifter LS provided in a (i+1)-th shift register circuit SR (the adjacent shift register circuit to the right of the figure) via its Q.

Further, the pulse processing circuit 905 includes a delay circuit corresponding to each shift register circuit SR. The buffer 920 includes a pre-charge buffer circuit BuP and a sampling buffer circuit BuS corresponding to each shift register circuit SR.

The pre-charge buffer circuit BuP outputs a pre-charge pulse, and the sampling buffer circuit BuS outputs a sampling pulse. For example, corresponding to the i-th shift register circuit SRb, the pulse processing circuit 905 includes a delay circuit 906 and a delay circuit 910, the pre-charge buffer circuit BuS includes an inverter circuit 918P which is a cascade two-stage circuit and an inverter 919P, and the sampling buffer BuS includes an inverter circuit 918S which is a cascade two-stage circuit and an inverter 919S. Note that, each of the delay circuits 906 and 910 is a cascade four-stage circuit. Note that, the inverter circuit 918P, the inverter circuit 918S, and the delay circuits 906 and 910 each have a single input terminal and a single output terminal.

The input of the delay circuit 906 is connected to the OUTB of the level shifter LSa (provided in the (i−1)-th shift register circuit SRa), and the output of the delay circuit 906 is connected to the input of the inverter circuit 918P and the input of the inverter 919P. Further, the input of the delay circuit 910 is connected to the Q of the flip-flop SR-FFb (provided in the i-th shift register circuit SRb), and the output of the delay circuit 910 is connected to the input of the inverter circuit 918*s* and the input of the inverter 919*s*. Here, as shown in FIG. 22, at the time where the OUTB of the level shifter LSa becomes active, the pre-charge pulse serving as an output signal of the inverter circuit 918P becomes active with a delay (this delay is caused by the delay circuit 906). At the time where the OUTB of the level shifter LSa becomes inactive, the pre-charge pulse becomes inactive with a delay (the delay is caused by the delay circuit 906). A conventional art related to the present invention can be found in the following Patent Document 1, for example.

[Patent Document 1] Japanese Unexamined Patent Publication Tokukaihei 7-295520 (published on Nov. 10, 1995)

DISCLOSURE OF INVENTION

In general, the output of the shift register circuit SR has a blunt rise or a blunt return fall due to characteristic of the material transistor.

The following discusses a conventional structure with reference to FIG. 22. In the output of the level shifter LSa, the width (active period) of the pre-charge pulse varies depending on whether the output has a sharp rise and a blunt return fall (upper figure), or the output has a blunt rise and a sharp return fall (lower figure). This variation results in variation in pre-charge time. This is because one end of the pre-charge pulse is generated by a rise of an output pulse from the shift register circuit SR, while the other end is generated by a return fall of the output pulse from the shift register circuit SR. Note that, the pulse width of the sampling pulse also can vary.

The present invention was made in view of the foregoing problems, and an object is to provide a particular structure and a method for a pulse generation circuit provided in a drive circuit or the like of a display apparatus, which can ensure high accuracy of pulse generation.

In order to attain the foregoing object, a drive circuit for a display apparatus according to the present invention comprises: a shift register; and a pulse generation circuit for generating a drive pulse signal using an output pulse signal generated in the shift register, wherein the pulse generation circuit forms (defines) a pulse-starting edge and a pulse-termination edge of the drive pulse signal using a rise or a fall of pulse resulting from activation of the output pulse signal.

Examples of the drive pulse signal include a pre-charge pulse and a sampling pulse.

The shift register includes plural stages of shift register circuit, each of which includes a flip-flop (such as a set-reset type flip-flop). Further, each shift register circuit may include a level shifter or various logic circuits. The output pulse signal is outputted from the output Q or the level shifter of the flip-flop provided in the shift register circuit.

Therefore, by constituting the shift register to generate pulses so that a rise of pulse resulting from activation of the output pulse signal is sharper than a subsequent fall of pulse, or a fall of pulse resulting from activation of the output pulse signal is sharper than a return rise of pulse (the design focusing more on the pulse-starting edge), the pulse width of the pre-charge pulse can be highly-accurately set. In this way, the problem of a decrease in driving (pre-charge or sampling) period due to uneven transistor characteristic, or inadequate driving timing (pre-charge or sampling timing) can be solved. On this account, display quality of the display apparatus is improved.

The drive circuit for a display apparatus according to the present invention may be arranged so that the drive pulse signal is generated from first and second output pulse signals, and the pulse-starting edge of the drive pulse signal is formed of the first output pulse signal, and the pulse-termination edge of the drive pulse signal is formed of the second output pulse signal.

The drive circuit for a display apparatus according to the present invention may be arranged so that the drive circuit for a display apparatus as set forth in claim 3, wherein the drive pulse signal is generated for each stage of the shift register, the first output pulse signal forming the pulse-starting edge of the drive pulse signal for a given stage is generated within the same stage or a preceding stage, and the second output pulse signal forming the pulse-termination edge of the drive pulse signal for a given stage is generated within the same stage or a later stage.

The drive circuit for a display apparatus according to the present invention may be arranged so that the pulse generation circuit includes a level shifter having an input terminal and a control terminal, the level shifter carries out level shift of a pulse signal fetched through the input terminal before outputting the pulse signal when the control terminal has a first potential, the level shifter outputs a signal of a certain potential when the control terminal has a second potential, the first output pulse signal being supplied to the input terminal and the second output pulse signal being supplied to the control terminal. In this case, the first and second output pulse signals may be respectively supplied to the input terminal and the control terminal via a level shift circuit which carries out level shift of a signal supplied thereto before outputting the signal. Further, the first and second output pulse signals may be respectively supplied to the input terminal and the control terminal via a delay circuit.

The drive circuit for a display apparatus according to the present invention may be arranged so that the pulse generation circuit includes a logic circuit, and the first and second output pulse signals are supplied to the logic circuit. In this case, the first and second output pulse signals may be respectively supplied to the logic circuit via a level shift circuit which carries out level shift of a signal supplied thereto before outputting the signal. Further, the first and second output pulse signals may be respectively supplied to the logic circuit via a delay circuit.

The drive circuit for a display apparatus according to the present invention may be arranged so that the drive pulse signal is a pre-charge pulse signal, and the first output pulse signal forming the pulse-starting edge of the pre-charge pulse signal is generated in a stage preceding to the given stage, and the second output pulse signal forming the pulse-starting edge of the pre-charge pulse signal is generated within the same stage.

The drive circuit for a display apparatus according to the present invention may be arranged so that the drive pulse signal is a sampling pulse signal, and the first output pulse signal forming the pulse-starting edge of the sampling pulse signal is generated within the same stage, and the second output pulse signal forming the pulse-starting edge of the sampling pulse signal is generated in a stage later than the given stage.

A drive circuit for a display apparatus according to the present invention comprises: a shift register; a pre-charge pulse generation circuit for generating a pre-charge pulse signal using an output pulse signal from the shift register; and a sampling pulse generation circuit for generating a sampling pulse signal using an output pulse signal from the shift register, wherein: the pre-charge pulse generation circuit forms a pulse-starting edge and a pulse-termination edge of the pre-charge pulse signal using a rise of pulse or a fall of pulse resulting from activation of the output pulse signal, and the sampling pulse generation circuit forms a pulse-starting edge and a pulse-termination edge of the sampling pulse signal using a rise of pulse or a fall of pulse resulting from activation of the output pulse signal.

The drive circuit for a display apparatus according to the present invention is preferably arranged so that the shift register is structured to generate pulses so that a rise of pulse resulting from activation of the output pulse signal is sharper than a return fall of pulse, or a fall of pulse resulting from activation of the output pulse signal is sharper than a return rise of pulse.

The drive circuit for a display apparatus according to the present invention may be arranged so that the pre-charge pulse generation circuit includes either a logic circuit, or a level shifter which carries out level shift of a pulse signal fetched through an input terminal before outputting the pulse signal when a control terminal has a first potential, the level shifter outputting a signal of a certain potential when the control terminal has a second potential, the sampling pulse generation circuit includes either a logic circuit, or a level shifter which carries out level shift of a pulse signal fetched through an input terminal before outputting the pulse signal when a control terminal has a first potential, the level shifter outputting a signal of a certain potential when the control terminal has a second potential.

The drive circuit for a display apparatus according to the present invention may be arranged so that the pre-charge pulse signal is generated from two output pulse signals, one of which forms the pulse-starting edge of the pre-charge pulse signal while the other forms the pulse-termination edge of the pre-charge pulse signal, the sampling pulse signal is also generated from two output pulse signals, one of which forms the pulse-starting edge of the sampling pulse signal while the other forms the pulse-termination edge of the sampling pulse signal.

The drive circuit for a display apparatus according to the present invention may be arranged so that the pre-charge pulse signal and the sampling pulse signal are generated for each stage of the shift register, the output pulse signal forming the pulse-starting edge of the pre-charge pulse signal for a given stage is generated in a stage preceding to the given stage, and the output pulse signal forming the pulse-termination edge of the pre-charge pulse signal for a given stage is generated within the same stage, the output pulse signal forming the pulse-starting edge of the sampling pulse signal for a given stage is generated within the same stage, and the output pulse signal forming the pulse-termination edge of the sampling pulse signal for a given stage is generated in a stage later than the given stage.

The drive circuit for a display apparatus according to the present invention may be arranged so that the pre-charge pulse generation circuit includes a first NOR circuit supplied with an output pulse signal generated in a stage preceding to the given stage and an output pulse signal generated in the given stage, the sampling pulse generation circuit includes (i) a NAND circuit supplied with an inversion pulse signal of an output of the first NOR circuit and an output pulse signal generated in the given stage, and (ii) a second NOR circuit supplied with an output of the NAND circuit and an output pulse signal generated in a stage later than the given stage.

A drive circuit for a display apparatus according to the present invention comprises: a shift register; and a pulse generation circuit for generating a drive pulse signal using an output pulse signal from the shift register, wherein the pulse generation circuit forms a pulse-starting edge and a pulse-termination edge of the drive pulse signal using a subsequent fall of the output pulse signal which has risen as being activated or a subsequent rise of the output pulse signal which has fallen as being activated. In this case, the shift register is structured to generate pulses so that a rise of pulse resulting from activation of the output pulse signal is sharper than a return fall of pulse, or a fall of pulse resulting from activation of the output pulse signal is sharper than a return rise of pulse.

A drive circuit for a display apparatus according to the present invention comprises: a shift register constituted of a plurality of stages, for driving a display apparatus which carries out writing of data into a data signal line and pre-charging of a predetermined data signal line at a stage later than said data signal line, wherein: each stage of the shift register outputs a pulse signal, the shift register generates a rise of a pre-charge pulse for pre-charging an n-th data signal line, in response to a fall of a pulse signal outputted from a stage preceding to the n-th stage of the shift register as a result of activation of the pulse signal, and generates a fall of the pre-charge pulse in response to a rise of a pulse signal outputted from a stage later than the n-th stage of the shift register as a result of activation of the pulse signal. In this case, the drive circuit may generate a rise of a sampling pulse for writing data into an n-th data signal line, in response to the return fall of the pre-charge pulse.

A drive circuit for a display apparatus according to the present invention comprises: a shift register constituted of a plurality of stages, for driving a display apparatus which carries out writing of data into a data signal line and pre-charging of a predetermined data signal line at a stage later than said data signal line, wherein: each stage of the shift register outputs a pulse signal, the shift register generates a rise of a sampling pulse for writing data into an n-th data signal line which corresponds to an n-th stage of the shift register, in response to a rise of the pulse signal outputted from the n-th stage of the shift register as a result of activation of the pulse signal, and generates a fall of the sampling pulse in response to a rise of a pulse signal outputted from a stage later than the n-th stage of the shift register as a result of activation of the pulse signal.

A pulse generation method according to the present invention is a method for generating a drive pulse signal using an output pulse signal generated in a shift register, wherein a pulse-starting edge and a pulse-termination edge of the drive pulse signal are formed using a rise or a fall of pulse resulting from activation of the output pulse signal.

The pulse generation method according to the present invention is preferably arranged so that the output pulse signal is structured such that a rise of pulse resulting from activation of the output pulse signal is sharper than a subsequent fall of pulse, or a fall of pulse resulting from activation of the output pulse signal is sharper than a return rise of pulse.

A display apparatus according to the present comprises the foregoing drive circuit for a display apparatus.

As described, according to the drive circuit for a display apparatus of the present invention, both of the pulse-starting edge and the pulse-termination edge of the drive pulse signal (such as a pre-charge pulse or a sampling pulse) are formed by a rise or a fall of pulse resulting from activation of the output pulse signal. Therefore, by constituting the shift register to generate pulses so that a rise of pulse resulting from activation of the output pulse signal is sharper than a return fall of pulse, or a fall of pulse resulting from activation of the output pulse signal is sharper than a subsequent rise of pulse, the pulse width of the pre-charge pulse can be highly-accurately set. In this way, the problem of a decrease in driving (pre-charge or sampling) period due to uneven transistor characteristic, or inadequate driving timing (pre-charge or sampling timing) can be solved. On this account, display quality of the display apparatus is improved.

BRIEF DESCRIPTION OF DRAWINGS

FIG. 5(*b*) A circuit diagram showing another structure of the level shifter LSy.

FIG. 6(*b*) A circuit diagram showing another structure of the level shifter LSx.

BEST MODE FOR CARRYING OUT THE INVENTION

Figure 4:
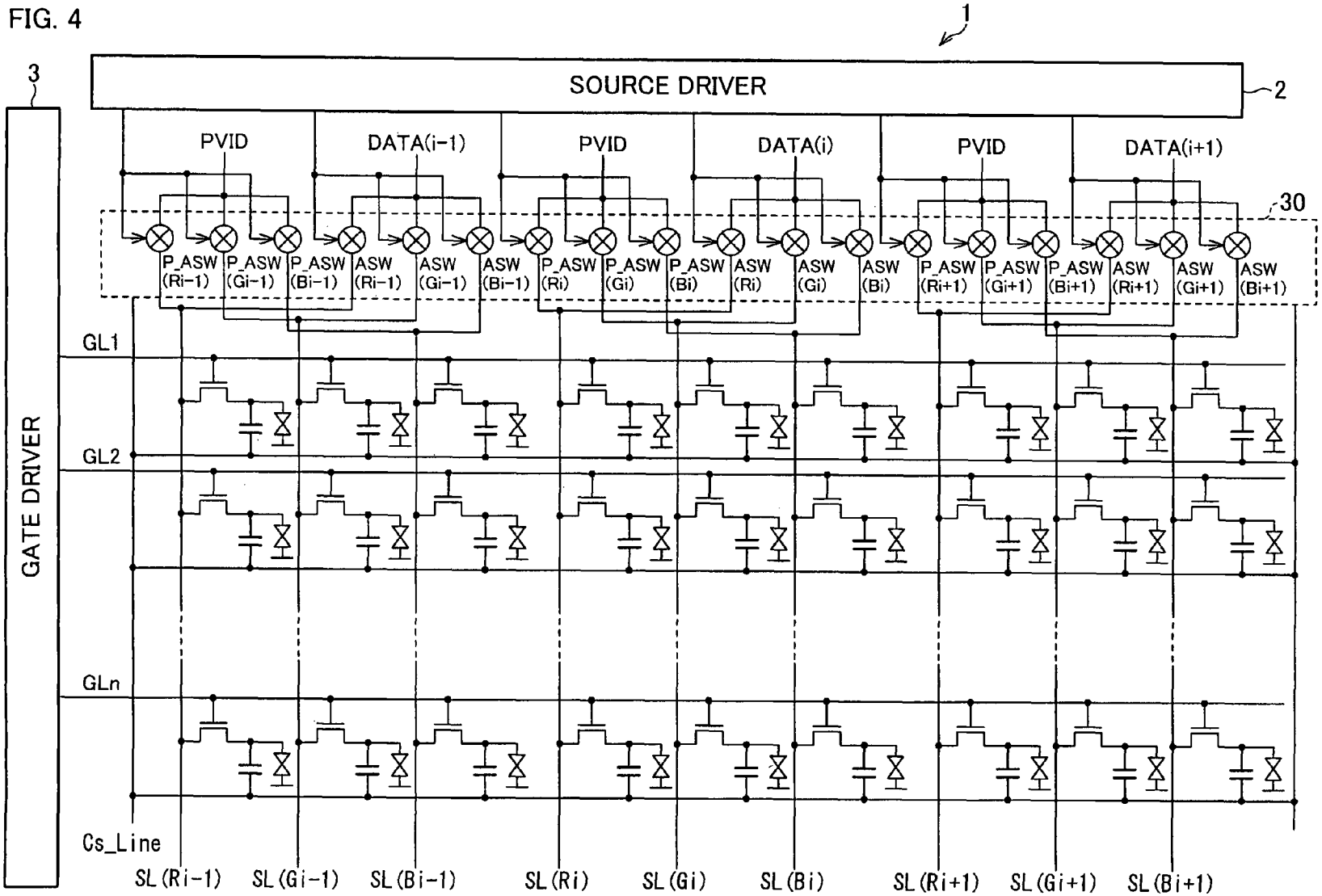
FIG. 4 A circuit diagram showing a structure of a display apparatus used for the embodiments.

FIG. 4 shows a structure example of a display panel 1 (such as a liquid-crystal display panel) according to the present embodiment. As shown in the figure, the display panel 1 includes gate bus lines GL . . . , source bus lines SL . . . corresponding to RGB, and a pixel at each intersection of those bus lines GL and SL. To carry out display in the display panel 1, a source driver writes a video signal to a pixel of the gate bus line GL selected by a gate driver 3, via the source bus lines SL. The source driver 2 in the figure is a later-described source driver according to the present embodiment. Note that, each pixel includes a liquid crystal capacitor, an auxiliary capacitor, and a TFT for fetching a video signal from the source bus lines SL, one end of the respective auxiliary capacitors being connected one another by an auxiliary capacitor line, a Cs-Line.

The display panel 1 includes a sampling circuit block 30, that is made up of analog switches ASW, provided for the respective source bus lines SL for sampling video signals, and control signal processing circuits (sampling buffer etc.) for the switches. The source driver outputs signals (sampling pulse) indicating ON/OFF state of the sampling switch ASW for each group consisting of RGB source bus lines SL. Each of RGB lines has an individual video signal transmission line, allowing simultaneous but individual sampling for RGB from the switches ASW; however, in this example, a signal is fetched from a common video signal transmission line to the all sampling switches ASW of RGB for the sake of convenience. Note that, the sampling switches ASW may be controlled by a common sampling pulse as a control signal for all groups, or by different pulses for the respective groups.

In a horizontal period, for example, the source bus lines SL of R sequentially fetch externally supplied video signals DATA by turning on, by the sampling pulses, the analog switches ASW (R1), . . . , ASW (Ri−1), ASW (Ri), ASW (Ri+1) . . . (in this order), that are connected to the source bus line SL of R. In this manner, the externally supplied video signals DATA are written into the source bus lines SL.

The following explains a structure of the source driver 2 for outputting sampling signals to the analog switches ASW (1), . . . , (i−1), (i), (i+1), . . . in this order.

First Embodiment

Figure 3:
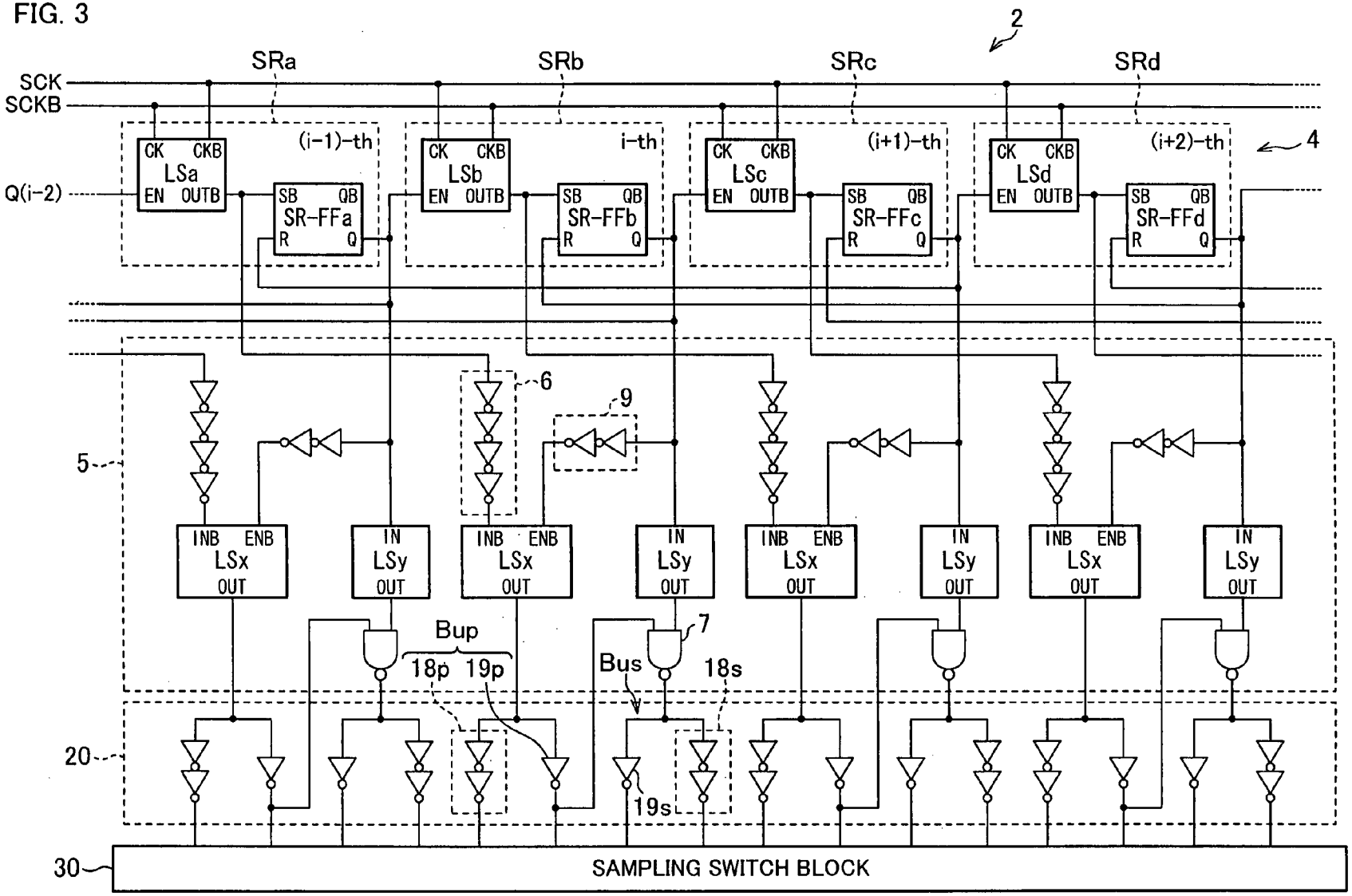
FIG. 3 A circuit diagram showing a structure of the source driver according to First Embodiment.

FIG. 3 is a circuit diagram showing a structure of a source driver according to First Embodiment of the present invention.

The shift register 904 includes a large number of shift register stages (circuits) SR. Among them, an (i−1)-th shift register circuit SRa, an i-th shift register circuit SRb, an (i+1)-th shift register circuit SRc, and an (i+2)-th shift register circuit SRd are discussed here. Each shift register circuit SR includes a flip-flop SR-FF and a level shifter LS. The level shifter LS serves to carry out level shift of clocks (CK and CKB), which are fetched when the EN terminal is active, and outputs the results through an OUTB. The flip-flop SR-FF is a set-reset type flip-flop having an input SB (set bar), a reset R, and outputs Q and QB.

A flip-flop SR-FF of each i-th shift register circuit SR is connected to the OUTB of the level shifter LS in the same stage via its SB, and connected to the Q of the (i+2)-th shift register circuit SR (the second adjacent shift register circuit to the right of the figure) via its R, and also connected to an EN terminal of a level shifter LS provided in a (i+1)-th shift register circuit SR (the adjacent shift register circuit to the right of the figure) via its Q.

The shift register circuit SRa includes a level shifter LSa and a flip-flop SR-FFa, the shift register circuit SRb includes a level shifter LSb and a flip-flop SR-FFb, the shift register circuit SRc includes a level shifter LSc and a flip-flop SR-FFc, and the shift register circuit SRd includes a level shifter LSd and a flip-flop SR-FFd.

Further, the pulse processing circuit 5 includes two delay circuits, two level shifters, and a NAND with two inputs corresponding to each shift register circuit SR. The buffer 20 includes a pre-charge buffer circuit BuP and a sampling buffer circuit BuS corresponding to each shift register circuit SR. The pre-charge buffer circuit BuP outputs a pre-charge pulse, and the sampling buffer circuit BuS outputs a sampling pulse. Note that, each NAND is a general circuit for outputting a result of logical multiplication, and serves to output "No". In this embodiment, the polarity of the output is determined for the sake of convenience.

In the source driver 2 according to the present embodiment, for example, corresponding to the i-th shift register circuit SRb, the pulse processing circuit 5 includes a level shifter LSx, a level shifter LSy, a delay circuit 6, delay circuit 9, and a NAND7. The delay circuit 6 is constituted of a cascade four-stage inverter, and the delay circuit 9 is constituted of a cascade two-stage inverter. The delay circuits 6 and 9 each have a single input terminal and a single output terminal. Further, corresponding to each i-th shift register circuit SRb, the buffer 20 includes an inverter circuit 18P and an inverter 19P serving as a sampling buffer BuS. The inverter circuits 18P and 18S are each constituted of a cascade two-stage inverter having a single input terminal and a single output terminal.

Figure 5:
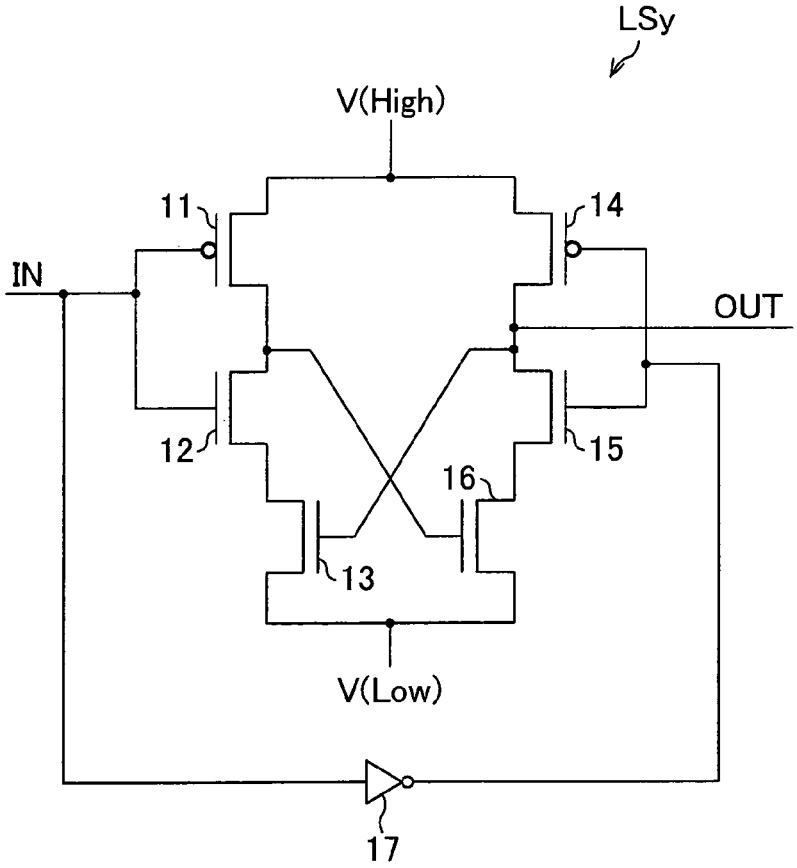
FIG. 5(*a*) A circuit diagram showing a structure of a level shifter LSy.
Figure 5:
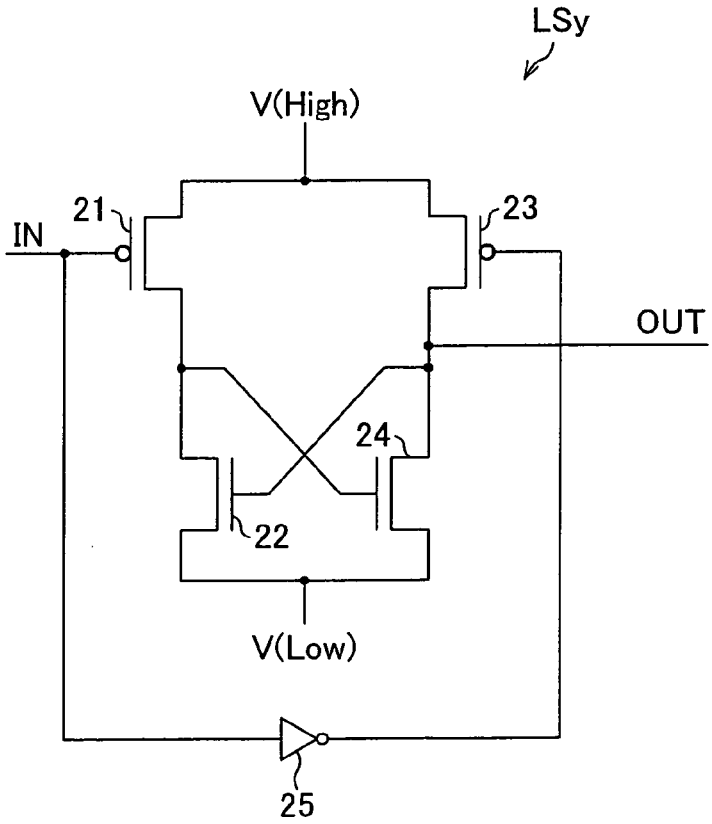

The level shifter LSy has the structure shown in FIG. 5(*a*), for example. As shown in the figure, the level shifter LSy includes a p-type TFTs 11 and 14, n-type TFTs 12, 13, 15 and 16, and an inverter 17. The gates of the TFT11 and 12 are connected to an input terminal IN of the level shifter LSy. The input terminal of the inverter 17 is also connected to the input terminal IN of the level shifter LSy. The output terminal of the inverter 17 is connected to the gates of the TFTs 14 and 15. The sources of the TFTs 11 and 14 are connected to a high-level power source terminal V(High), and the sources of the TFTs 13 and 16 are connected to a low-level power source terminal V(Low). The drain of the TFT11 is connected to the drain of the TFT12. The source of the TFT12 is connected to the drain of the TFT13. The drain of the TFT14 and the drain of the TFT15 are connected to each other, and the junction is further connected to the output terminal OUT of the level shifter LSy. The source of the TFT15 and the drain of the TFT16 are connected to each other. The gate of the TFT13 is connected to the junction between the TFT14 and the TFT15. The gate of the TFT16 is connected to the junction between the TFT11 and the TFT12. In response to input of a pulse to a corresponding input terminal IN, the level shifter LSy outputs the low level of the pulse as a level of power source Vssd and also outputs the high level of the pulse as a level of the power source Vdd, from the output terminal OUT.

FIG. 5(*b*) shows another structure of the level shifter LSy. As shown in the figure, this level shifter LSy is a voltage-driven-type level shifter constituted of four transistors, including a p-type TFTs 21 and 23, n-type TFTs 24 and 25, and an inverter 25. The gate of the TFT21 is connected to an input terminal IN. The input terminal of the inverter 25 is also connected to the input terminal IN. The output terminal of the inverter 25 is connected to the gate of the TFT 23. The sources of the TFTs 21 and 23 are connected to a high-level power source terminal V(High), and the sources of the TFTs 22 and 24 are connected to a low-level power source terminal V(Low). The drain of the TFT21 is connected to the drain of the TFT23. The drain of the TFT23 and the drain of the TFT24 are connected to each other, and the junction is further connected to the output terminal OUT. The gate of the TFT22 is connected to the junction between the TFT23 and the TFT24. The gate of the TFT24 is connected to the junction between the TFT21 and the TFT22.

Figure 6:
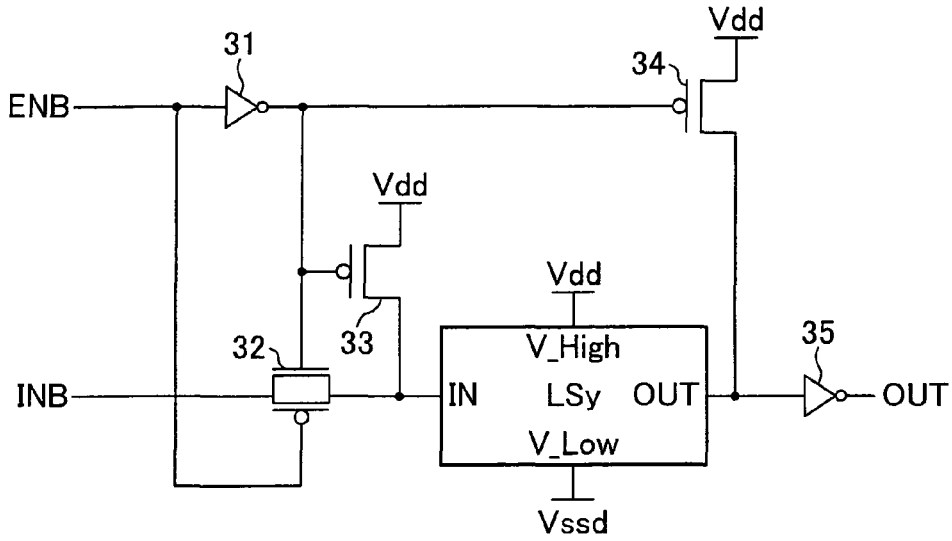
FIG. 6(*a*) A circuit diagram showing a structure of a level shifter LSx.
Figure 6:
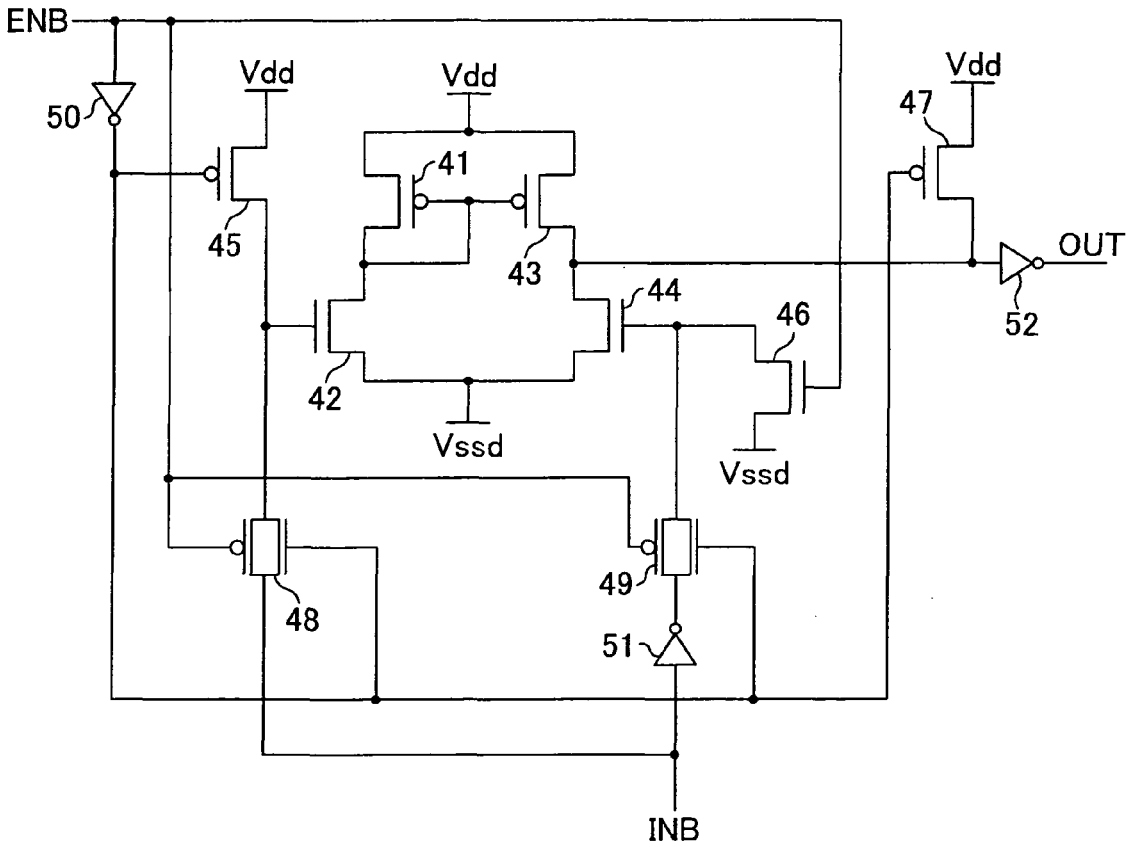

Further, the level shifter LSx includes a structure shown in FIG. 6(*a*), for example. The level shifter LSx includes a level shifter LSy, an inverter 31, an analog switch 32, a p-type TFT33, a p-type TFT34, and an inverter 35. The level shifter LSy is a voltage-driven-type level shifter constituted of six transistors. This type of voltage-driven-type level shifter is shown in FIG. 5(*a*) or FIG. 5(*b*). The structure is the same as above. The input terminal IN of the level shifter LSy is connected to the input terminal INB of the level shifter 3*b* via the analog switch 32. The enable terminal ENB is connected to an input terminal of the inverter 31, and also connected to the gate of the p-type TFT of the analog switch 32. The output terminal of the inverter 31 is connected to the gate of the n-type TFT of the analog switch 32, and also connected to the gate of the TFT33 and the gate of the TFT34. Further, the drain of the TFT33 is connected to the input terminal IN of the level shifter LSy. The source of the TFT33 is connected to the power source Vdd. The source of the TFT34 is connected to the power source Vdd, and the drain of the TFT34 is connected to the output terminal OUT of the level shifter LSy, and also connected to the input terminal of the inverter 35. The output terminal of the inverter 35 serves as the output terminal of the level shifter LSx. The high-level power source terminal V(High) of the level shifter LSy is connected to the power source Vdd, and the low-level power source terminal V(Low) of the level shifter LSy is connected to the power source Vssd. In the level shifter LSx, the gate of the TFT33 is supplied with a high level and the gate of the TFT34 is supplied with a low level while the input signal to the input terminal ENB is kept at a low level. That is, the TFTs 33 and 34 are OFF. On the other hand, the analog switch 32 is ON. Consequently, the signal supplied to the input terminal INB of the level shifter LSx is subjected to power-source voltage conversion, and the result is outputted through the output terminal OUT. Meanwhile, while the signal supplied to the input terminal ENB is kept at a high level, the analog switch 32 is OFF, the TFT33 is ON, and the TFT34 is ON. Consequently, the power-source voltage conversion of the output pulse by the level shifter LSy is stopped, and the output terminal OUT of the level shifter LSy is pulled up to the power source Vdd. As a result, a low level is outputted from the output terminal OUT of the level shifter 3*b*.

FIG. 6(*b*) shows another structure of a level shifter LSx. This level shifter is a voltage-driven-type level shifter, and includes p-type TFTs 41, 43, 45 and 47, n-type TFTs 42, 44 and 46, analog switches 48 and 49, and inverters 50, 51 and 52. The input terminal INB is connected to the gate of the TFT42 and the drain of the TFT45 via the analog switch 48. The input terminal INB is connected to the gate of the TFT44 and the drain of the TFT46 via a sequence of the inverter 51 and the analog switch 49. An enable terminal ENB is connected to the gate of the TFT46, and also connected to the gates of the p-type TFT of the analog switch 48 and the p-type TFT of the analog switch 49. Further, the enable terminal ENB is connected to the gates of the TFT45 and 47 via an inverter 50, and also connected to the gates of n-type TFT of the analog switch 48 and the n-type TFT of the analog switch 49. The sources of the TFTs 41, 43, 45 and 47 are connected to the power source Vdd, and the sources of the TFT42 and 44 are connected to the power source Vssd. The source of the TFT46 is connected to the power source Vss. the gates of the TFTs 41 and 43 are connected to each other, and the junction is connected to the drain of the TFT41. The drains of the TFT41 and the drain of the TFT42 are connected to each other. The drain of the TFT43 and the drain of the TFT44 are connected to each other, and the junction is connected to the input terminal of the inverter 52 and also connected to the drain of the TFT47. The output terminal of the inverter 52 is connected to the output terminal OUT.

Though the input terminal is pulled up in the structure of the present embodiment, the input terminal of the inverter 51 may be pulled down to inverse the polarity of the sampling pulse. This is the same for the other embodiments described later.

The level shifter LSx generates a pre-charge pulse for operating the sampling circuit block 30 using a pulse supplied to the gate of the input terminal INB, and outputs the pre-charge pulse through the output terminal OUT. This signal is supplied to the gates of the n-type TFT and the p-type TFT of the analog switch ASW provided in the sampling circuit block 30 via the pre-charge buffer circuit BuP. This gate signal is also supplied to one of the input terminals of the NAND7. The NAND7 generates a sampling pulse for driving the sampling circuit block 30 using a pulse supplied to an input terminal, and outputs the sampling pulse through the output terminal.

Back to FIG. 3, the input of the delay circuit 6 is connected to the OUTB of the level shifter LSa (provided in the (i−1)-th shift register circuit SRa), and the output of the delay circuit 6 is connected to the INB terminal of the level shifter LSx. Further, the input of the delay circuit 9 is connected to the output Q of the i-th flip-flop SR-FFb (provided in the shift register circuit SRb) and the IN terminal of the level shifter LSy. The output of the delay circuit 9 is connected to the ENB terminal of the level shifter LSx. The OUT terminal of the level shifter LSx is connected to the input of the inverter circuit 18P and the input of the inverter 19P. Further, the output of the inverter 19P is connected to one of the inputs of the NAND7, and the other input of the NAND7 is connected to the OUT terminal of the level shifter LSy. The output of the NAND7 is connected to the input of the inverter circuit 18S and the input of the inverter 19S.

Figure 1:
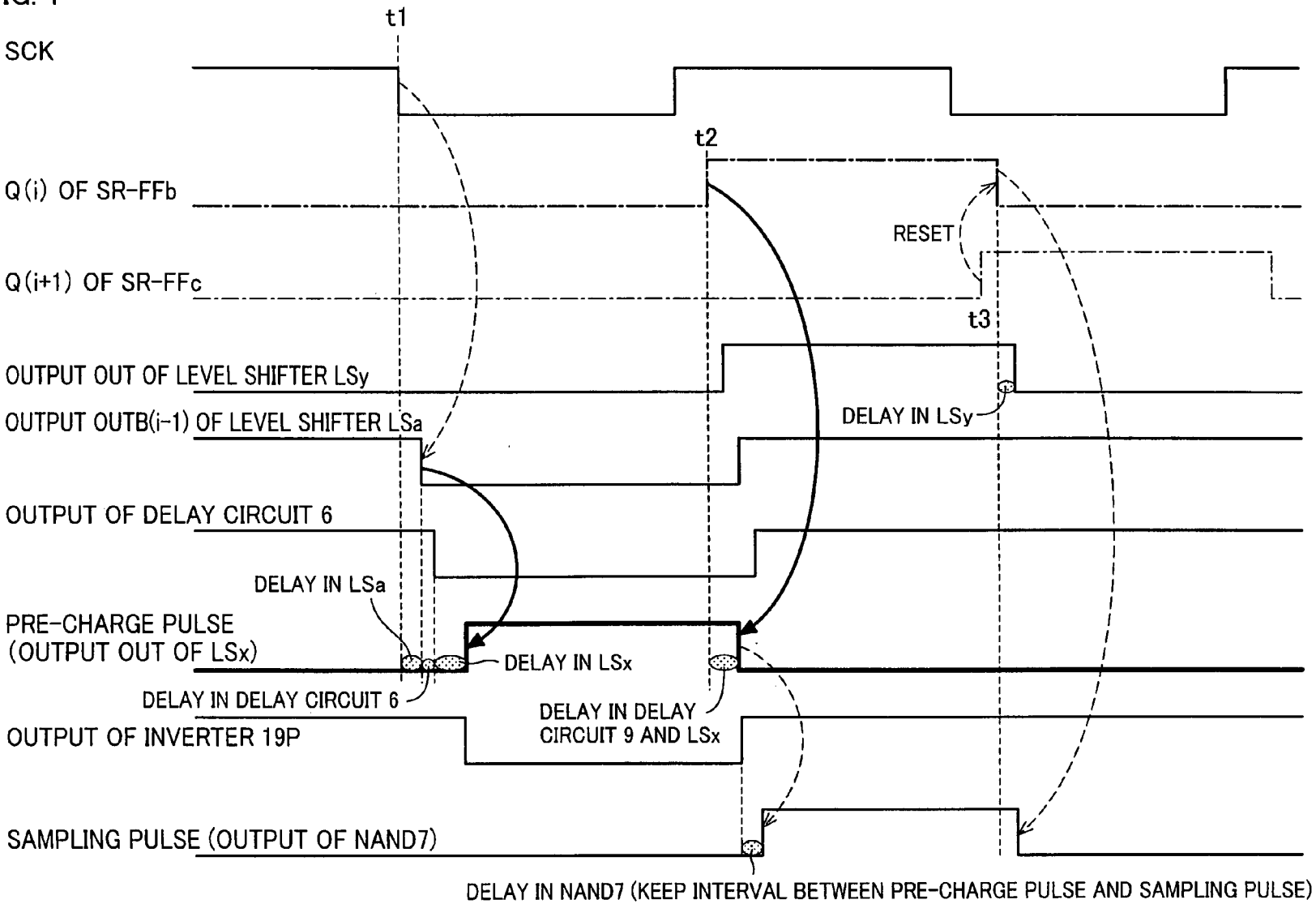
FIG. 1 A timing chart showing an operation of a source driver according to First Embodiment.

The following describes an operation of the source driver shown in FIG. 3, with reference to FIG. 1.

First, when the SCK becomes "L" at t1, the output terminal OUTB of the level shifter LSa becomes "L(active)" (falls) with a delay. The delay is caused by an internal delay of the level shifter LSa. When the output terminal OUTB of the level shifter LSa becomes "L(active)", the output of the delay circuit 6 also becomes "L(active)" (falls) with a delay. The delay is caused by the delay circuit 6. When the output of the delay circuit 6 becomes "L(active)", the INB terminal of the level shifter LSx becomes "L", and the ENB terminal also becomes "L". As a result, the output terminal OUT of the level shifter LSx becomes "H(active)" (rises), delayed from the activation of the delay circuit 6 (the delay is caused by an internal delay of the level shifter LSx). At this time, the level shifter LSx starts outputting the pre-charge pulse. In this manner, the output pulse of the level shifter LSa serves as a source pulse for generating a pre-charge pulse (for forming a pulse-starting edge).

Next, when the output Q of the SR-FFb becomes "H(active)" at t2, the ENB terminal of the level shifter LSx becomes "H", and the input from its INB terminal is blocked. As a result, the OUT terminal of the level shifter LSx outputs "L", delayed from the activation of the SR-FFb (the delay is caused by internal delays of the delay circuit 9 and the level shifter LSx). At this time, the level shifter LSx finishes the output of pre-charge pulse. In this manner, the output pulse Q(i) of the flip-flop SR-FFb serves as a source pulse for generating a pre-charge pulse (for forming a pulse-termination edge).

When the OUT terminal of the level shifter LSx becomes "L" again, the output of the inverter circuit 19 becomes "H". As a result, the output of the NAND7 becomes "H(active)", delayed from the turning of the output of the inverter circuit 19 into "H" again (the delay is caused by the NAND7). At this time, the NAND7 starts outputting the sampling pulse. The provision of NAND7 thus keeps an interval between the pre-charge pulse and the sampling pulse.

Next, when the output Q of the flip-flop SR-FFc becomes "H" at t3, the output Q of the flip-flop SR-FFb is reset and becomes "L" again. Consequently, the output OUT of the level shifter LSy becomes "L(inactive)" again, delayed from this resetting of the flip-flop SR-FFb. This delay is caused by an internal delay of the level shifter LSy. When the output OUT of the level shifter LSy becomes "L(inactive)", one of the inputs of the NAND7 becomes "L", and the output of the NAND7 becomes "L". At this time, the NAND7 finishes the output of sampling pulse.

In this manner, the pre-charge pulse (output pulse from the OUT of the level shifter LSx) is generated by the two source pulses, namely, the pulse outputted from the level shifter LSa, and the pulse outputted from the flip-flop SR-FFb. The fall (activation) of the pulse outputted from the level shifter LSa forms a pulse-starting edge, and the rise (activation) of the pulse outputted from the flip-flop SR-FFb forms a pulse-termination edge. Therefore, by providing a sharp rise or fall of pulse in response to activation of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus is improved.

By thus designing the delay circuits 6 and 9 so that the pulse-starting edge and the pulse-termination edge of the pre-charge pulse are formed at rapid timings (or deleted if not required), the width of the pre-charge pulse (pre-charge period) can be set to a desired length with high accuracy.

Figure 7:
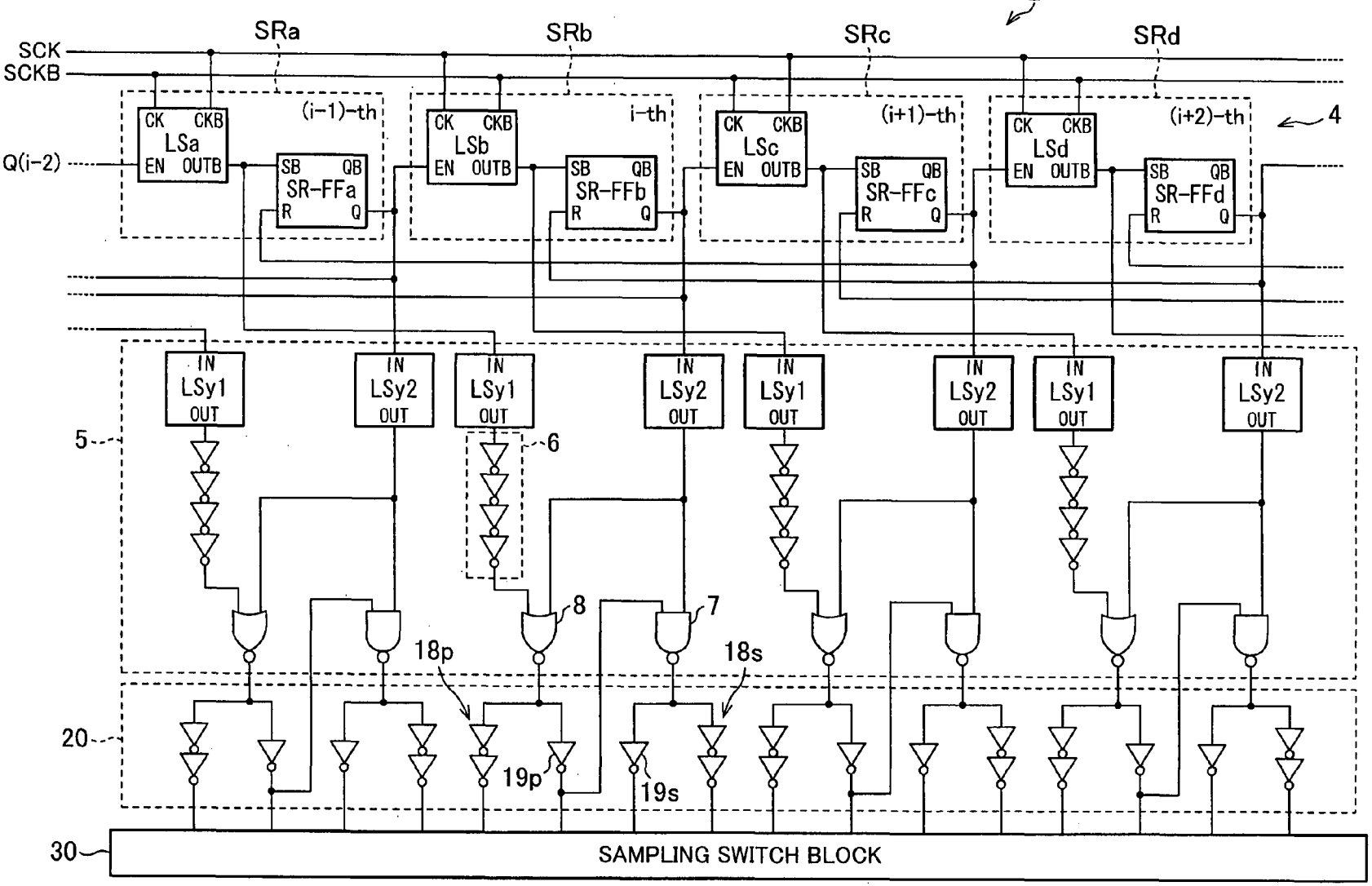
FIG. 7 A circuit diagram showing a structure of the source driver according to First Embodiment.

Alternatively, the pulse processing circuit 5 may have the structure shown in FIG. 7, with the same layouts of the shift register 4 and the buffer 20. More specifically, corresponding to the shift register circuit SR, a single delay circuit, two level shifters, an NOR with two inputs and a NAND with two inputs are provided. For example, the pulse processing circuit 5 corresponding to the i-th shift register circuit SRb includes two level shifters LSy1 and LSy2 identical in structure to the level shifter LSy, a delay circuit 6, a NOR8 and a NAND7. Note that, the NOR8 is a general circuit for outputting a result of logical multiplication, and serves to output "No". In this embodiment, the polarity of the output is determined for the sake of convenience. This is the same for the other embodiments described later.

The delay circuit 6 is constituted of a cascade four-stage inverter, and includes a single input terminal and a single output terminal. The IN terminal of the level shifter LSy1 is connected to the OUTB of the level shifter LSa (provided in the (i−1)-th shift register circuit SRa), and the OUT terminal of the level shifter LSy1 is connected to the input of the delay circuit 6. The output of the delay circuit 6 is connected to one of the inputs of the NOR8. The IN terminal of the level shifter LSy2 is connected to the output Q of the i-th flip-flop SR-FFb (provided in the shift register circuit SRb), and the OUT terminal is connected to the other input of the NOR8 and one of the inputs of the NAND7. The output of the NOR8 is connected to the input of the inverter circuit 18P and the input of the inverter 19P. Further, the output of the inverter 19P is connected to the other input of the NAND7, and the output of the NAND7 is connected to the input of the inverter circuit 18S and the input of the inverter 19S.

Also in this structure of FIG. 7, when the output terminal OUTB of the level shifter LSa becomes "L(active)", the output of the delay circuit 6 also becomes "L(active)" with a delay, and one of the inputs of the NOR8 becomes "L" and the other input of the NOR8 becomes "L". As a result, the output of the NOR8 becomes "H (active)" (rises). At this time, the NOR8 starts outputting the pre-charge pulse. In this manner, the output pulse of the level shifter LSa serves as a source pulse for generating a pre-charge pulse (for forming a pulse-starting edge). Next, when the output Q of the SR-FFb becomes "H(active)", "H" is supplied to the NOR8 via the level shifter LSy2. Consequently, the output of the NOR8 becomes "H". At this time, the NOR8 finishes the output of pre-charge pulse. In this manner, the output pulse Q(i) of the flip-flop SR-FFb serves as a source pulse for generating a pre-charge pulse (for forming a pulse-termination edge).

In this way, the pre-charge pulse (output pulse from the NOR8) is generated by the two source pulses, namely, the pulse outputted from the level shifter LSa, and the pulse outputted from the flip-flop SR-FFb. The fall (activation) of the pulse outputted from the level shifter LSa forms a pulse-starting edge, and the rise (activation) of the pulse outputted from the flip-flop SR-FFb forms a pulse-termination edge. Therefore, by providing a sharp rise or fall of pulse in response to activation of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus 1 is improved.

Figure 8:
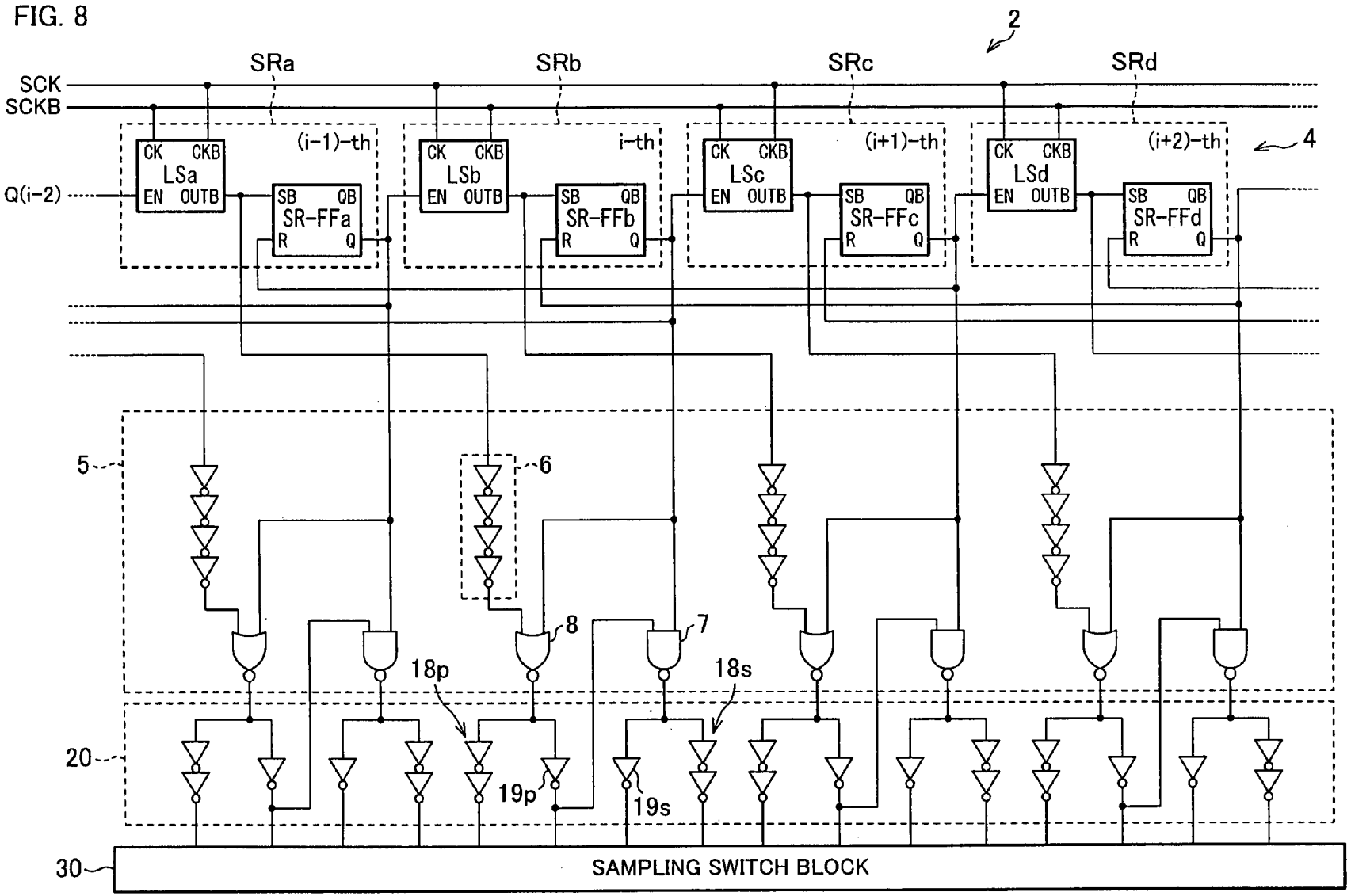
FIG. 8 A circuit diagram showing a structure of the source driver according to First Embodiment.

Note that, in FIG. 7, the level shifter LSy1 and the level shifter LSy2 serve only to shift a potential level of the input pulse, and therefore the level shifters LSy1 and LSy2 may be omitted from the structure of FIG. 7. This structure is shown in FIG. 8.

Figure 9:
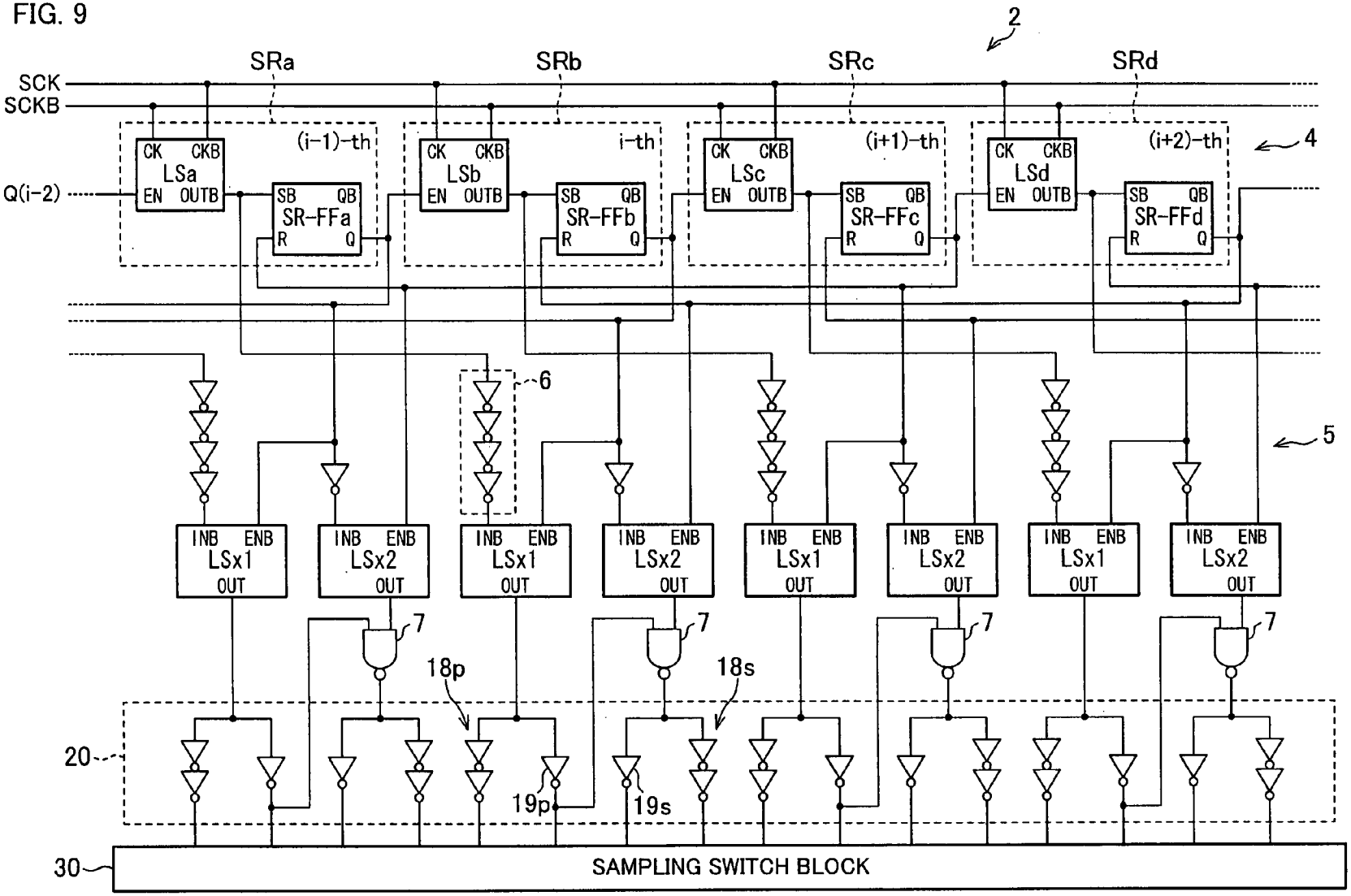
FIG. 9 A circuit diagram showing a structure of the source driver according to First Embodiment.

Alternatively, the pulse processing circuit 5 may have the structure shown in FIG. 9, with the same layouts of the shift register 4 and the buffer 20. More, specifically, corresponding to the shift register circuit SR, a single delay circuit, two level shifters, an inverter and a NAND with two inputs are provided. For example, the pulse processing circuit 5 corresponding to the i-th shift register circuit SRb includes two level shifters LSx1 and LSx2 identical in structure to the level shifter LSx, a delay circuit 6, and a NAND7. The delay circuit 6 is constituted of a cascade four-stage inverter, and includes a single input terminal and a single output terminal. The input of the delay circuit 6 is connected to the OUTB of the level shifter LSa (provided in the (i−1)-th shift register circuit SRa), and the output is connected to the INB terminal of the level shifter LSx1. The output Q of the i-th flip-flop SR-FFb (provided in the shift register circuit SRb) is connected to the ENB terminal of the level shifter LSx1 and the input of the inverter 10. The output of the inverter 10 is connected to the INB terminal of the level shifter LSx2. The level shifter LSx2 is connected to the output Q of the (i+2)-th shift register circuit SRd via its ENB terminal, and the OUT is connected to one of the inputs of the NAND7. Further, the OUT terminal of the level shifter LSx1 is connected to the input of the inverter 18P and the input of the inverter 19P.

The output of the inverter 19P is connected to the other input of the NAND7. The output of the NAND7 is connected to the input of the inverter circuit 18S and the input of the inverter 19S.

Second Embodiment

Figure 10:
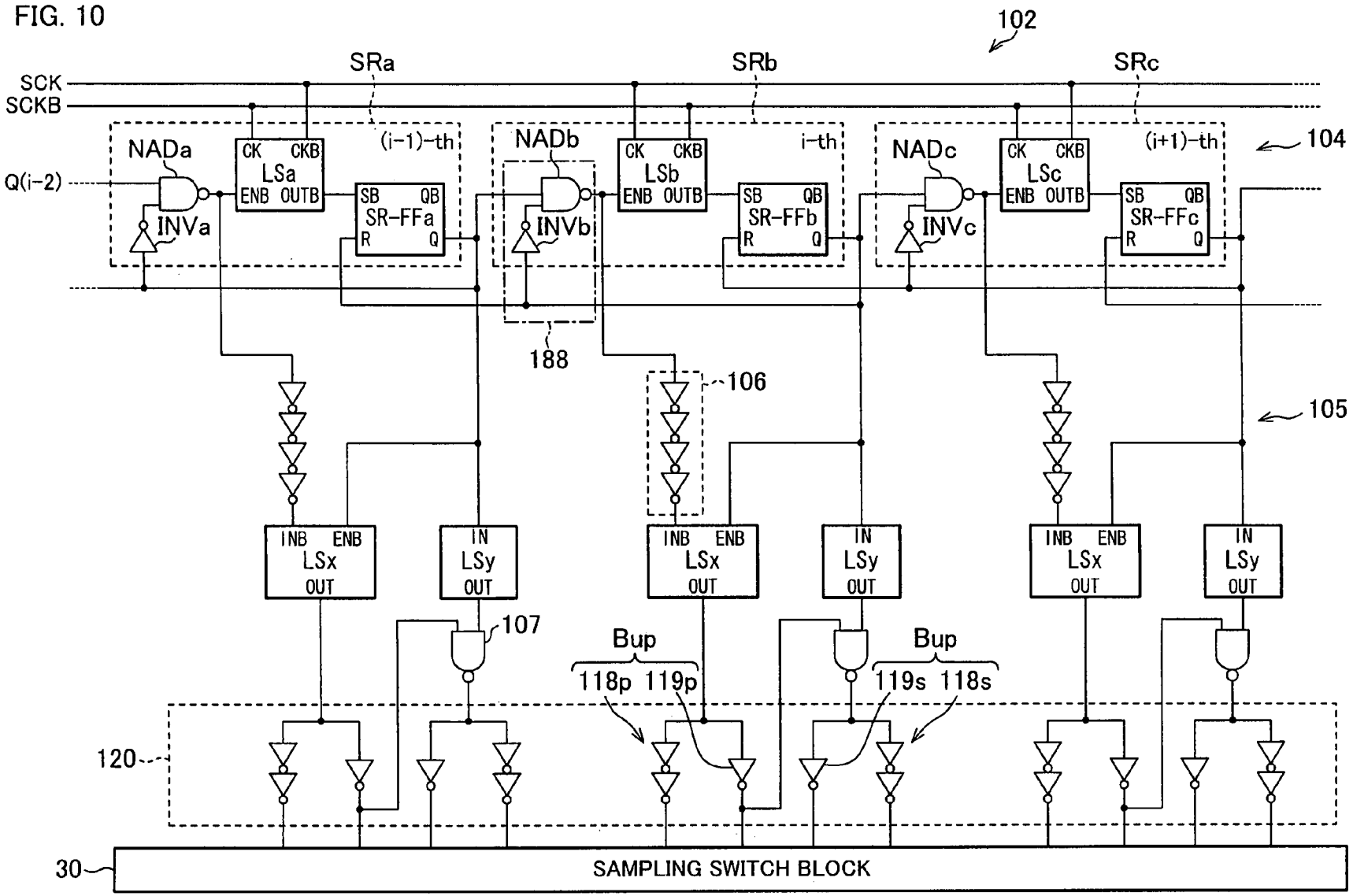
FIG. 10 A circuit diagram showing a structure of a source driver according to Second Embodiment.

FIG. 10 is a circuit diagram showing a structure of a source driver according to Second Embodiment of the present invention.

As shown in the figure, the source driver 102 includes a shift register 104, a pulse processing circuit 105, and a buffer 120. The shift register 104 includes a large number of shift register stages (circuits) SR. Among them, an (i−1)-th shift register circuit SRa, an i-th shift register circuit SRb, an (i+1)-th shift register circuit SRc, and an (i+2)-th shift register circuit SRd are discussed here. Each shift register circuit SR includes a flip-flop SR-FF, a level shifter LS, a NAND with two inputs, and an inverter. The level shifter LS serves to carry out level shift of clocks (CK and CKB), which are fetched when the EN terminal is active, and outputs the results through an OUTB. The flip-flop SR-FF is a set-reset type flip-flop having an input SB (set bar), a reset R, and outputs Q and QB.

In each shift register circuit SR, the input of the inverter INV is connected to the output Q of a flip-flop SR-FF in the same stage, and the output of the inverter INV is connected to one of the inputs of the NAND. The other input of the NAND is connected to the output Q of the flip-flop SR-FF (provided in the shift register circuit SR) to the left, and the output (of the NAD) is connected to the ENB of the level shifter LS in the same stage. The flip-flop SR-FF is connected to the OUTB of the level shifter LS in the same stage via its SB, and connected via its R to the Q of the shift register circuit SR to the right, and also connected via its Q to the input of the NAND (referred to as a NAD in the figure as appropriate) provided in the shift register circuit SR to the right.

The shift register circuit SRa includes a NANDa (NADa), an inverter INVa, a level shifter LSa and a flip-flop SR-FFa. The shift register circuit SRb includes a NANDb (NADb), an inverter INVb, a level shifter LSb and a flip-flop SR-FFb. The shift register circuit SRc includes a NAND(NAD)c, an inverter INVc, a level shifter LSc and a flip-flop SR-FFc. The shift register circuit SRd includes a NAND(NAD)d, an inverter INVd, a level shifter LSd and a flip-flop SR-FFd.

Further, the pulse processing circuit 105 includes a single delay circuits, two level shifters, and a NAND with two inputs corresponding to each shift register circuit SR. The buffer 120 includes a pre-charge buffer circuit BuP and a sampling buffer circuit BuS corresponding to each shift register circuit SR. The pre-charge buffer circuit BuP outputs a pre-charge pulse, and the sampling buffer circuit BuS outputs a sampling pulse. Note that, each NAND is a general circuit for outputting a result of logical multiplication, and serves to output "No". In this embodiment, the polarity of the output is determined for the sake of convenience.

In the source driver 102 according to the present embodiment, for example, corresponding to the i-th shift register circuit SRb, the pulse processing circuit 105 includes a level shifter LSx, a level shifter LSy, a delay circuit 106, and a NAND107. The delay circuit 106 is constituted of a cascade four-stage inverter, and has a single input terminal and a single output terminal. Further, corresponding to an i-th shift register circuit SRb, the buffer 120 includes an inverter circuit 118P and an inverter 119P serving as a pre-charge buffer circuit BuS, and an inverter circuit 118S and an inverter 119S as a sampling buffer BuS. Each of these inverter circuits has a single input terminal and a single output terminal. Note that, the logical circuit 188 constituted of a NADb and an inverter INVb is a general circuit for outputting a result of logical multiplication, and serves to output "No". In this embodiment, the polarity of the output is determined for the sake of convenience. This is the same for the other embodiments described later.

The input of the delay circuit 106 is connected to the output of the NANDa (provided in the (i−1)-th shift register circuit SRa), and the output of the delay circuit 106 is connected to the INB terminal of the level shifter LSx. The output Q of the i-th flip-flop SR-FFb is connected to the IN terminal of the level shifter LSy and the ENB terminal of the level shifter LSx. The OUT terminal of the level shifter LSx is connected to the input of the inverter circuit 118P and the input of the inverter 119P. Further, the output of the inverter 119P is connected to one of the inputs of the NAND107, and the other input of the NAND107 is connected to the OUT terminal of the level shifter LSy. The output of the NAND107 is connected to the input of the inverter circuit 118S and the input of the inverter 119S.

Also in the present embodiment, the pre-charge pulse (output pulse from the level shifter LSx) is generated by the two source pulses, namely, the pulse outputted from the flip-flop SR-FFa, and the pulse outputted from the flip-flop SR-FFb. The fall (activation) of the pulse outputted from the flip-flop SR-FFa forms a pulse-starting edge, and the rise (activation) of the pulse outputted from the flip-flop SR-FFb forms a pulse-termination edge. Therefore, by constituting the shift register 104 to be capable of providing a sharp rise/fall (activation) of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus 1 is improved.

Figure 11:
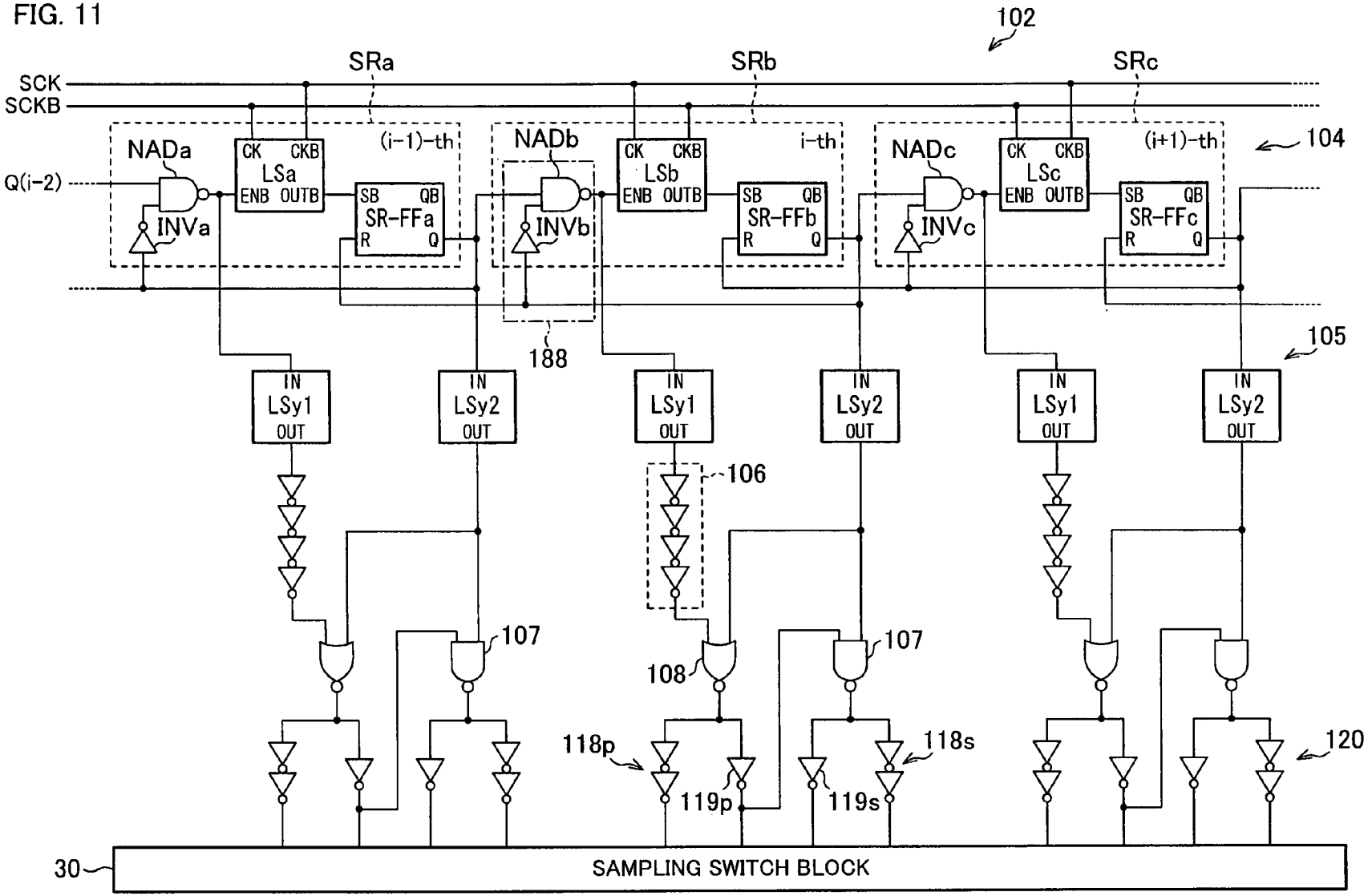
FIG. 11 A circuit diagram showing a structure of a source driver according to Second Embodiment.

Alternatively, the pulse processing circuit 105 may have the structure shown in FIG. 11, with the same layouts of the shift register 104 and the buffer 120. More specifically, corresponding to the shift register circuit SR, a single delay circuit, two level shifters, an NOR with two inputs and a NAND with two inputs are provided. For example, the pulse processing circuit 105 corresponding to the i-th shift register circuit SRb includes two level shifters LSy1 and LSy2 identical in structure to the level shifter LSy, a delay circuit 106, a NOR108 and a NAND107. The delay circuit 106 is constituted of a cascade four-stage inverter, and includes a single input terminal and a single output terminal. The IN terminal of the level shifter LSy1 is connected to the output of the NANDa (provided in the (i−1)-th shift register circuit SRa), and the OUT terminal of the level shifter LSy1 is connected to the input of the delay circuit 106. The output of the delay circuit 106 is connected to one of the inputs of the NOR108. The IN terminal of the level shifter LSy2 is connected to the output Q of the flip-flop SR-FFb (provided in the shift register circuit SRb), and the OUT terminal of the level shifter LSy2 is connected to the other input of the NOR108 and one of the inputs of the NAND107. The output of the NOR108 is connected to the input of the inverter circuit 118P and the input of the inverter 119P. The output of the NAND107 is connected to the input of the inverter circuit 118S and the input of the inverter 119S.

Also in the structure of FIG. 11, the pre-charge pulse (output pulse from the NOR108) is generated by the two source pulses, namely, the pulse outputted from the flip-flop SR-FFa, and the pulse outputted from the flip-flop SR-FFb. The fall (activation) of the pulse outputted from the flip-flop SR-FFa forms a pulse-starting edge, and the rise (activation) of the pulse outputted from the flip-flop SR-FFb forms a pulse-termination edge. Therefore, by constituting the shift register 104 to be capable of providing a sharp rise/fall (activation) of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus 1 is improved.

Figure 12:
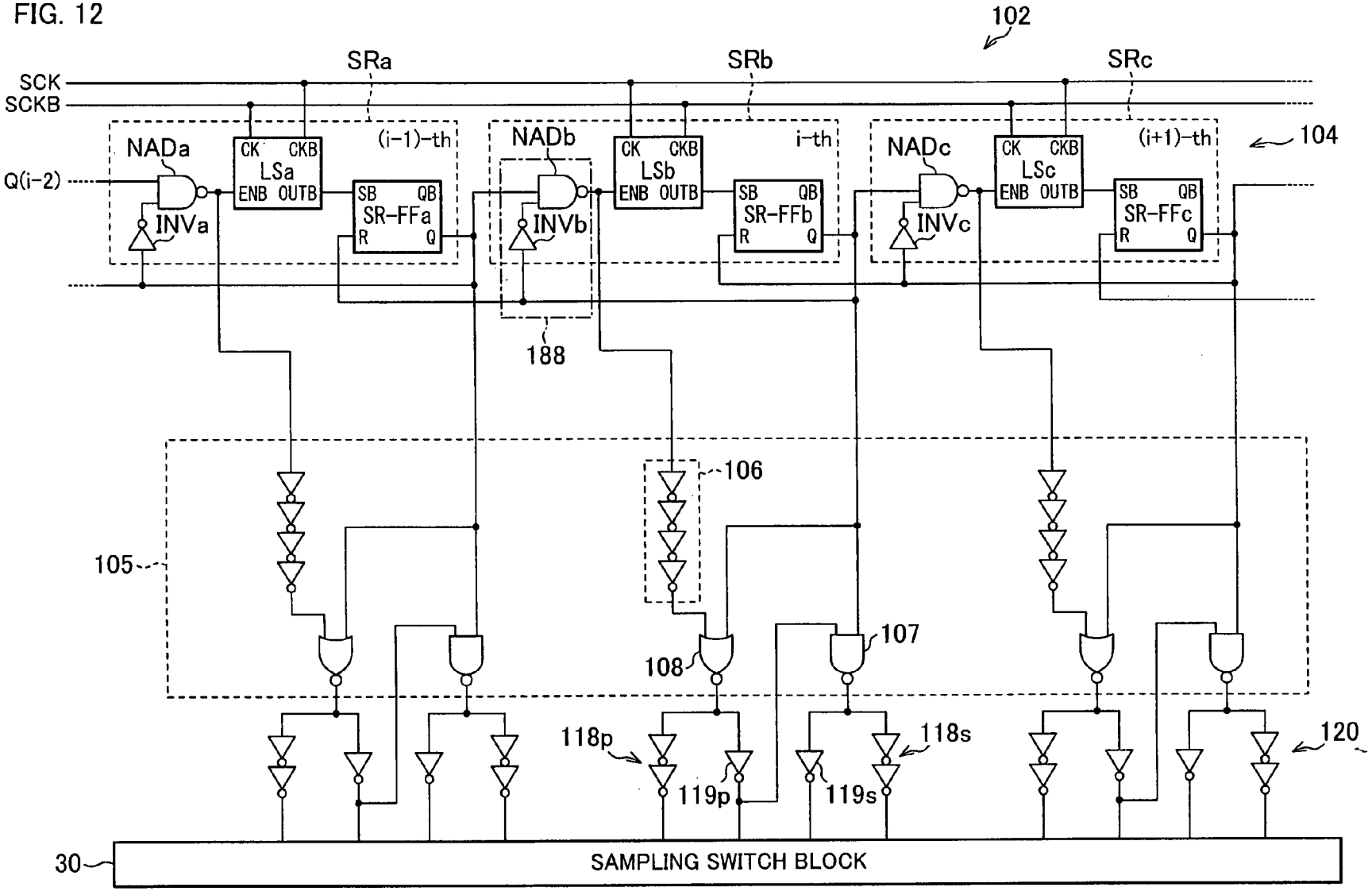
FIG. 12 A circuit diagram showing a structure of a source driver according to Second Embodiment.

Note that, in FIG. 11, the level shifter LSy1 and the level shifter LSy2 serve only to shift a potential level of the input pulse, and therefore the level shifters LSy1 and LSy2 may be omitted from the structure of FIG. 11. This structure is shown in FIG. 12.

Third Embodiment

Figure 13:
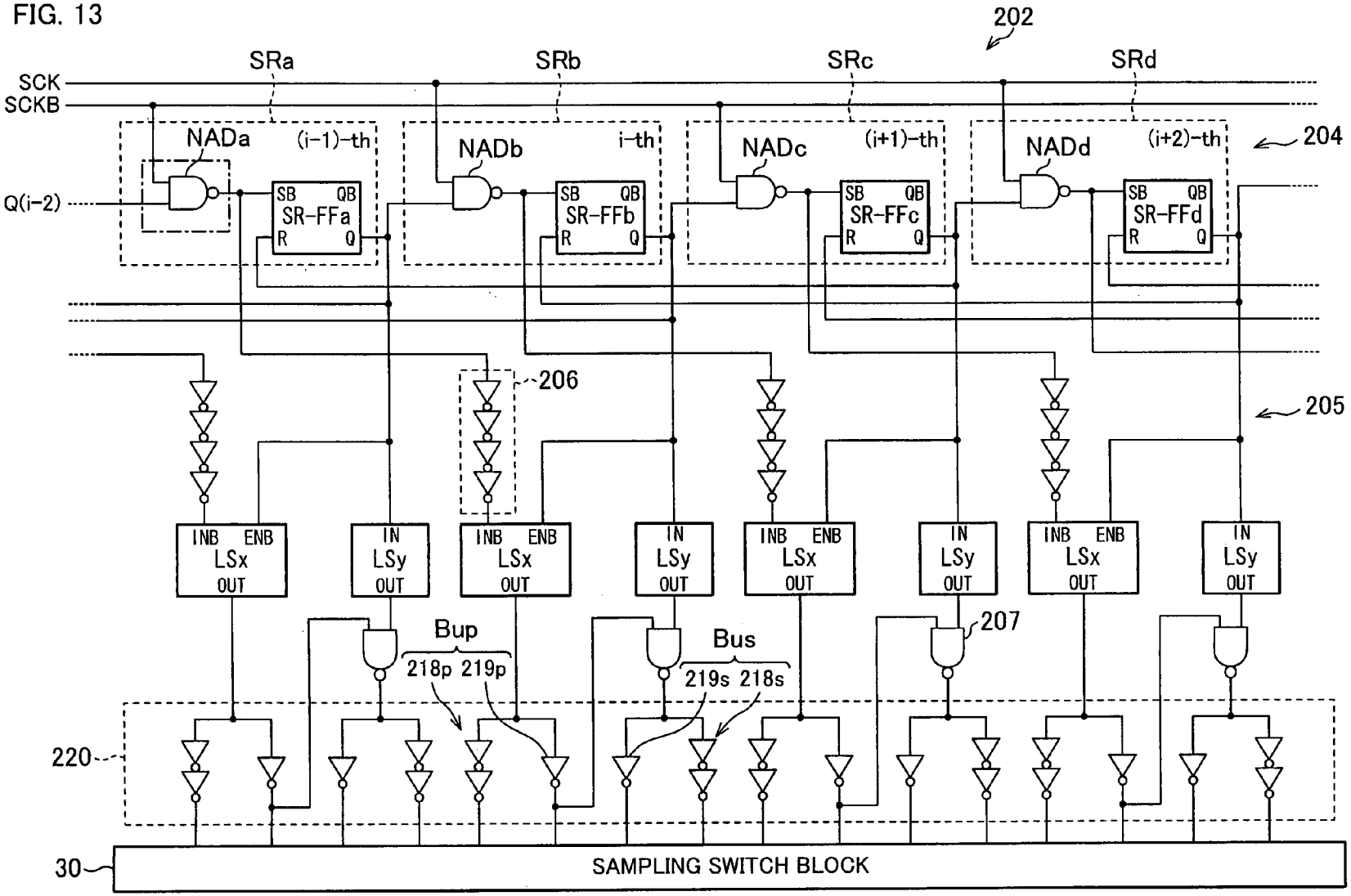
FIG. 13 A circuit diagram showing a structure of a source driver according to Third Embodiment.

FIG. 13 is a structure showing a circuit diagram showing a source driver according Third Embodiment of the present invention.

As shown in the figure, the shift register 202 includes a large number of shift register stages (circuits) SR. Among them, an (i−1)-th shift register circuit SRa, an i-th shift register circuit SRb, an (i+1)-th shift register circuit SRc, and an (i+2)-th shift register circuit SRd are discussed here. Each shift register circuit SR includes a flip-flop SR-FF and a NAND with two inputs. The flip-flop SR-FF is a set-reset type flip-flop having an input SB (set bar), a reset R, and outputs Q and QB.

A flip-flop SR-FF of each shift register circuit SR is connected to either of SCK or SCKB depending on whether it resides in an-odd number stage or an even-number stage via one of the inputs of the NAND. The other input of the NAND is connected to the output Q of the flip-flop SR-FF (provided in the shift register circuit SR) to the left, and the output (of the NAD) is connected to the input SB of the flip-flop SR-FF in the same stage. The flip-flop SR-FF is connected to the Q of the shift register circuit SR (the second adjacent shift register circuit SR to the right of the figure) via its reset R, and also connected via its Q to the NAND of the shift register circuit SR to the right. Note that, the NAD circuit in synchronism with the clock is a circuit for outputting a result of logical multiplication, and serves to output "No". In this embodiment, the polarity of the output is determined for the sake of convenience. The circuit NAD uses an output signal from the flip-flop SR-FF in the preceding stage and a source clock which is an input signal externally supplied to process a logic for outputting a signal in synchronism with a clock signal or a clock. The logic may be logical addition, logical multiplication, a composite logic of addition/multiplication, or a logic element such as an analog switch.

The shift register circuit SRa includes a NANDa and a flip-flop SR-FFa, the shift register circuit SRb includes a NANDb and a flip-flop SR-FFb, the shift register circuit SRc includes a NANDc and a flip-flop SR-FFc, and the shift register circuit SRd includes a NANDd and a flip-flop SR-FFd.

Further, the pulse processing circuit 205 includes a delay circuit, two level shifters, and a NAND with two inputs corresponding to each shift register circuit SR. The buffer 220 includes a pre-charge buffer circuit BuP and a sampling buffer circuit BuS corresponding to each shift register circuit SR. The pre-charge buffer circuit BuP outputs a pre-charge pulse, and the sampling buffer circuit BuS outputs a sampling pulse. Note that, each NAND is a general circuit for outputting a result of logical multiplication, and serves to output "No".

In the source driver 202 according to the present embodiment, a pulse processing circuit 205 of an i-th shift register circuit SR includes a level shifter LSx, a level shifter LSy, a delay circuit 206, and a NAND 207. The delay circuit 106 is constituted of a cascade four-stage inverter, and includes a single input terminal and a single output terminal. Further, corresponding to each i-th shift register circuit SRb, the buffer 220 includes an inverter circuit 218P and an inverter 219P serving as a pre-charge buffer circuit BuS, and an inverter circuit 218S and an inverter 219S serving as a sampling buffer BuS. The inverter circuits 218P and 218S are each constituted of a cascade two-stage inverter having a single input terminal and a single output terminal.

The input of the delay circuit 206 is connected to the output of the NANDa (provided in the (i−1)-th shift register circuit SRa), and the output of the delay circuit 206 is connected to the INB terminal of the level shifter LSx. The output Q of the i-th flip-flop SR-FFb is connected to the IN terminal of the level shifter LSy and the ENB terminal of the level shifter LSx. The OUT terminal of the level shifter LSx is connected to the input of the inverter circuit 218P and the input of the inverter 219P. Further, the output of the inverter 219P is connected to one of the inputs of the NAND207, and the other input of the NAND207 is connected to the OUT terminal of the level shifter LSy. The output of the NAND207 is connected to the input of the inverter circuit 218S and the input of the inverter 219S.

Also in the present embodiment, the pre-charge pulse (output pulse from the level shifter LSx) is generated by the two source pulses, namely, the pulse outputted from the flip-flop SR-FFa, and the pulse outputted from the flip-flop SR-FFb. The fall (activation) of the pulse outputted from the flip-flop SR-FFa forms a pulse-starting edge, and the rise (activation) of the pulse outputted from the flip-flop SR-FFb forms a pulse-termination edge. Therefore, by constituting the shift register 104 to be capable of providing a sharp rise/fall (activation) of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus 1 is improved.

Figure 14:
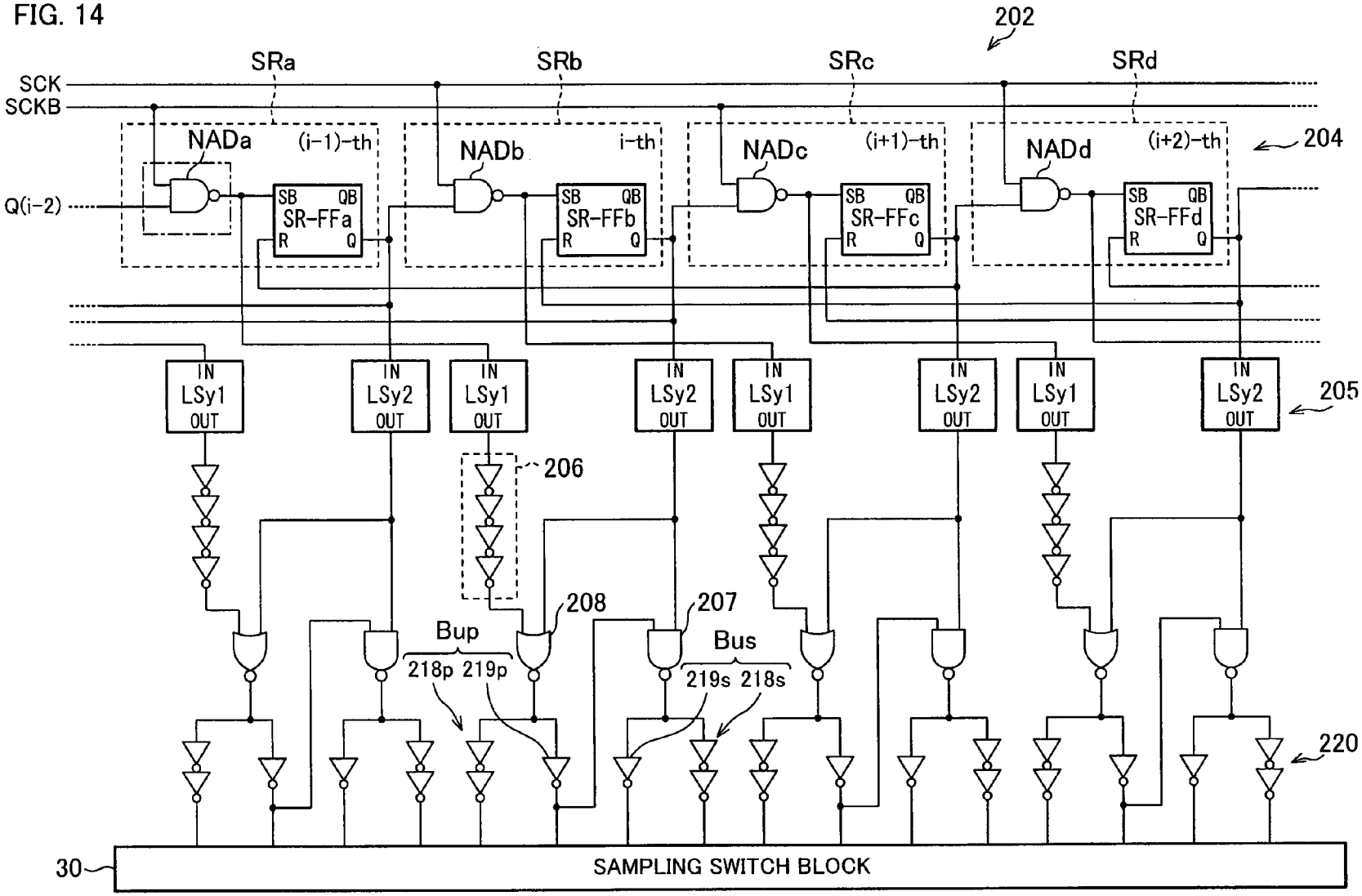
FIG. 14 A circuit diagram showing a structure of a source driver according to Third Embodiment.

Alternatively, the pulse processing circuit 205 may have the structure shown in FIG. 14, with the same layouts of the shift register 204 and the buffer 220. More specifically, corresponding to the shift register circuit SR, a single delay circuit, two level shifters, an NOR with two inputs and a NAND with two inputs are provided. For example, the pulse processing circuit 205 corresponding to the i-th shift register circuit SRb includes two level shifters LSy1 and LSy2 identical in structure to the level shifter LSy, a delay circuit 206, a NOR208 and a NAND207. The delay circuit 206 is constituted of a cascade four-stage inverter, and includes a single input terminal and a single output terminal. The IN terminal of the level shifter LSy1 is connected to the output of the NANDa (provided in the (i−1)-th shift register circuit SRa), and the OUT terminal of the level shifter LSy1 is connected to the input of the delay circuit 206. The output of the delay circuit 206 is connected to one of the inputs of the NOR208. The IN terminal of the level shifter LSy2 is connected to the output Q of the i-th flip-flop SR-FFb (provided in the shift register circuit SRb), and the OUT terminal of the level shifter LSy2 is connected to the other input of the NOR208 and one of the inputs of the NAND207. The output of the NOR208 is connected to the input of the inverter circuit 218P and the input of the inverter 219P. The output of the inverter 219P is connected to the other input of the NAND207, and the output of the NAND207 is connected to the input of the inverter circuit 218S and the input of the inverter 219S.

Also in this structure of FIG. 14, the pre-charge pulse (output pulse from the NOR208) is generated by the two source pulses, namely, the pulse outputted from the flip-flop SR-FFa, and the pulse outputted from the flip-flop SR-FFb. The fall (activation) of the pulse outputted from the flip-flop SR-FFa forms a pulse-starting edge, and the rise (activation) of the pulse outputted from the flip-flop SR-FFb forms a pulse-termination edge. Therefore, by constituting the shift register 204 to be capable of providing a sharp rise/fall (activation) of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus is improved.

Figure 15:
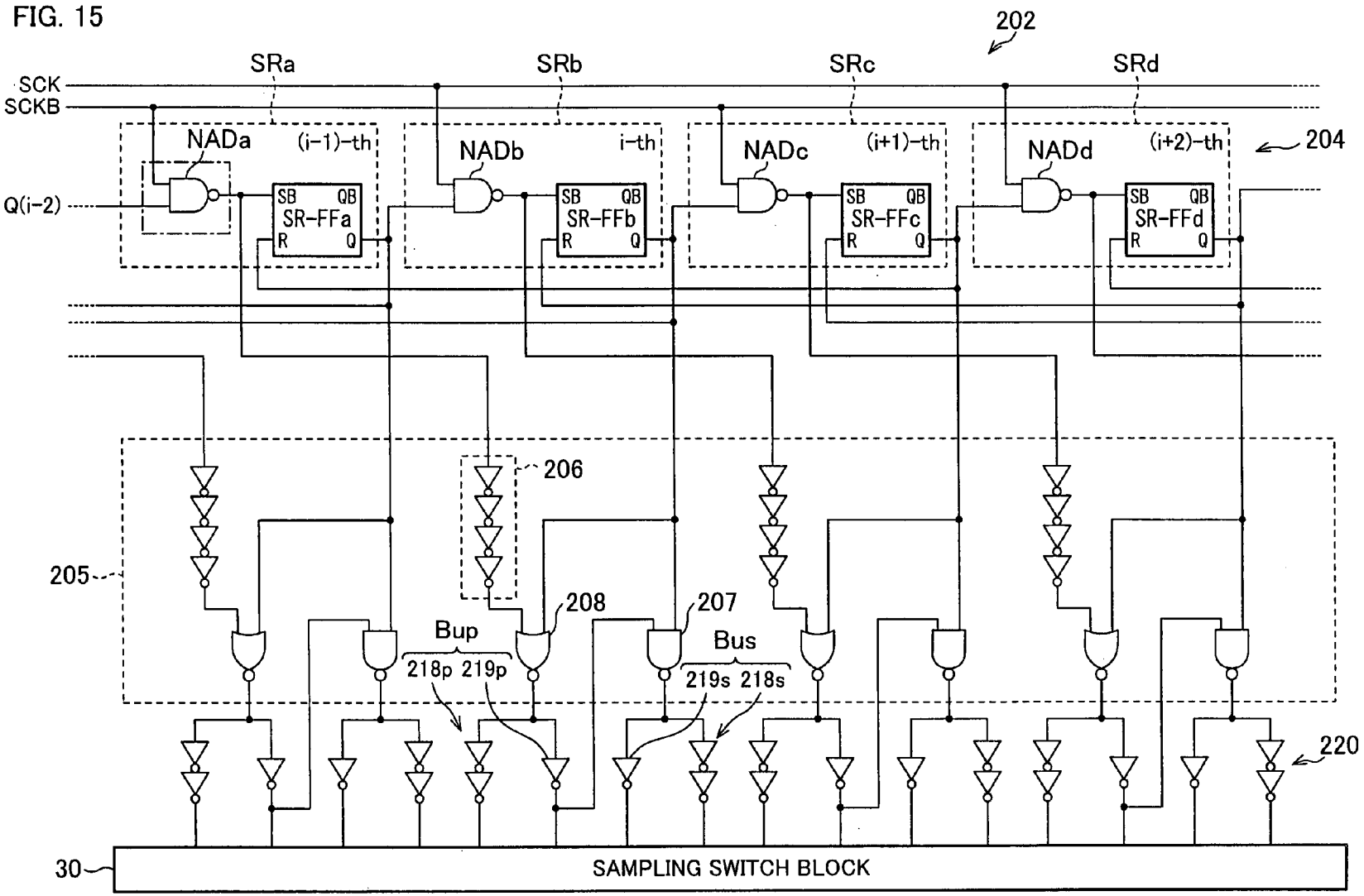
FIG. 15 A circuit diagram showing a structure of a source driver according to Third Embodiment.

Note that, in FIG. 14, the level shifter LSy1 and the level shifter LSy2 serve only to shift a potential level of the input pulse, and therefore the level shifters LSy1 and LSy2 may be omitted from the structure of FIG. 14. This structure is shown in FIG. 15.

Fourth Embodiment

Figure 16:
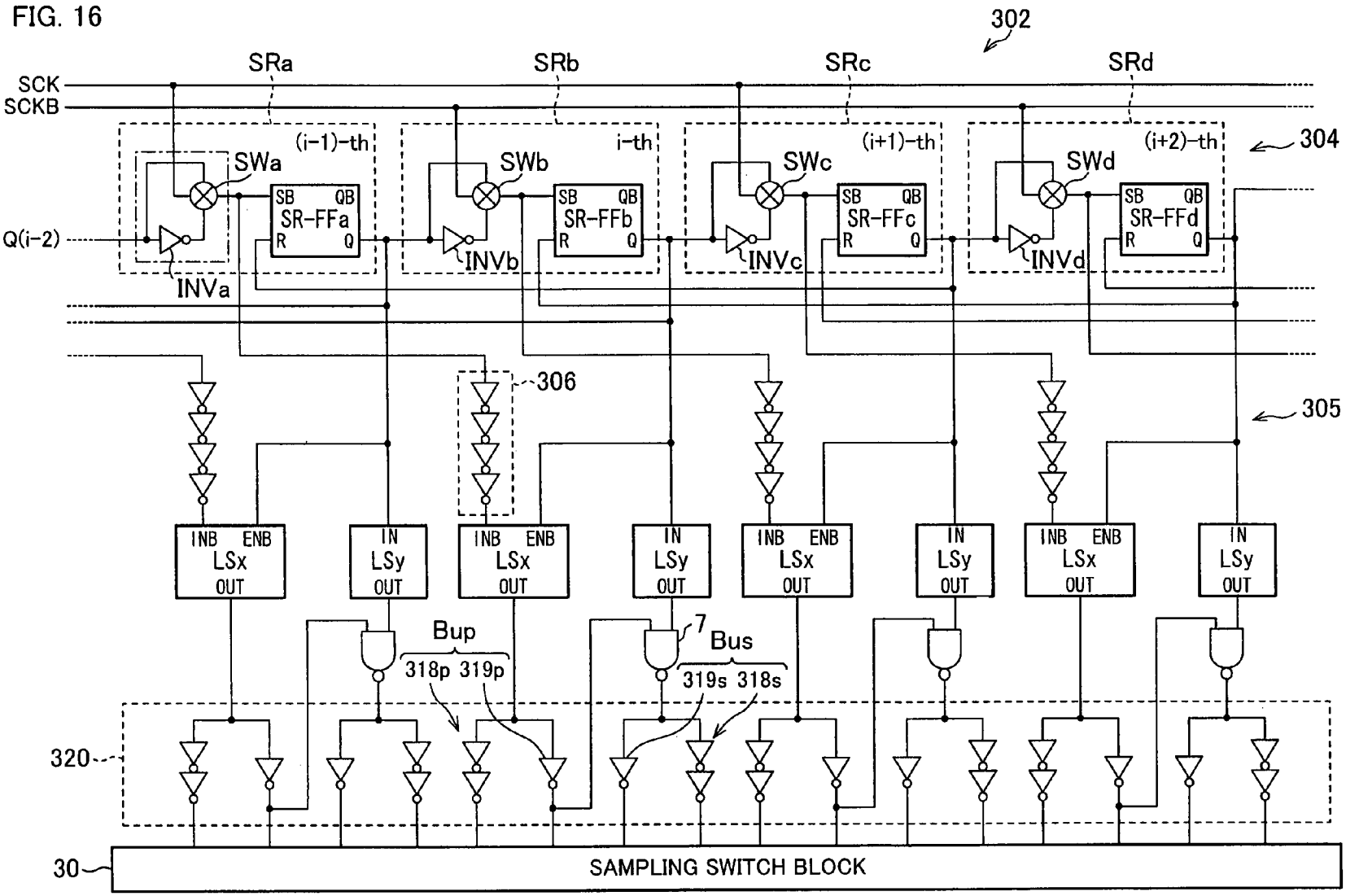
FIG. 16 A circuit diagram showing a structure of a source driver according to Fourth Embodiment.

FIG. 16 is a circuit diagram showing a structure according to Fourth Embodiment of the present invention.

As shown in the figure, the source driver 302 includes a shift register 304, a pulse processing circuit 305, a buffer 320. The shift register 304 includes a large number of shift register stages (circuits) SR. Among them, an (i−1)-th shift register circuit SRa, an i-th shift register circuit SRb, an (i+1)-th shift register circuit SRc, and an (i+2)-th shift register circuit SRd are discussed here. Each shift register circuit SR includes a flip-flop SR-FF, a single inverter INV and a switch SW. The flip-flop SR-FF is a set-reset type flip-flop having an input SB (set bar), a reset R, and outputs Q and QB.

In each shift register circuit SR, one of the conduction terminals of the switch SW is connected to either of SCK or SCKB depending on whether it resides in an-odd number stage or an even-number stage. The other conduction terminal (in the output end) is connected to the input SB of the flip-flop SR-FF in the same stage. The flip-flop SR-FF is connected to the Q of the shift register circuit SR (the second adjacent shift register circuit SR to the right of the figure) via its reset R, and also connected via its Q to the inverter INV of the shift register circuit SR to the right. Note that, the two control terminals of the switch SW are connected to the input and the output of the inverter INV.

The shift register circuit SRa includes a switch SWa, an inverter INVa and a flip-flop SR-FFa, the shift register circuit SRb includes a switch SWb, an inverter INVb and a flip-flop SR-FFb, the shift register circuit SRc includes a switch SWc, an inverter INVc and a flip-flop SR-FFc, and the shift register circuit SRd includes a switch SWd, an inverter INVd and a flip-flop SR-FFd.

Further, the pulse processing circuit 305 includes a delay circuit, two level shifters, and a NAND with two inputs corresponding to each shift register circuit SR. The buffer 320 includes a pre-charge buffer circuit BuP and a sampling buffer circuit BuS corresponding to each shift register circuit SR. The pre-charge buffer circuit BuP outputs a pre-charge pulse, and the sampling buffer circuit BuS outputs a sampling pulse. Note that, the NAND is a general circuit for outputting a result of logical multiplication, and serves to output "No". In this embodiment, the polarity of the output is determined for the sake of convenience.

In the source driver 302 according to the present embodiment, a pulse processing circuit 305 of an i-th shift register circuit SR includes a level shifter LSx, a level shifter LSy, a delay circuit 306, and a NAND 307. The delay circuit 306 is constituted of a cascade four-stage inverter, and includes a single input terminal and a single output terminal. Further, corresponding to each i-th shift register circuit SRb, the buffer 320 includes an inverter circuit 318P and an inverter 319P serving as a pre-charge buffer circuit BuS, and an inverter circuit 318S and an inverter 319S serving as a sampling buffer BuS. The inverter circuits 318P and 318S are each constituted of a cascade two-stage inverter having a single input terminal and a single output terminal.

The input of the delay circuit 306 is connected to the conduction terminal (in the output end) of the switch SWa (provided in the (i−1)-th shift register circuit SRa), and the output of the delay circuit 306 is connected to the INB terminal of the level shifter LSx. The output Q of the i-th flip-flop SR-FFb is connected to the IN terminal of the level shifter LSy and the ENB terminal of the level shifter LSx. The OUT terminal of the level shifter LSx is connected to the input of the inverter circuit 318P and the input of the inverter 319P. Further, the output of the inverter 319P is connected to one of the inputs of the NAND307, and the other input of the NAND307 is connected to the OUT terminal of the level shifter LSy. The output of the NAND307 is connected to the input of the inverter circuit 318S and the input of the inverter 319S.

Also in the present embodiment, the pre-charge pulse (output pulse from the level shifter LSx) is generated by the two source pulses, namely, the pulse outputted from the flip-flop SR-FFa, and the pulse outputted from the flip-flop SR-FFb. The fall (activation) of the pulse outputted from the flip-flop SR-FFa forms a pulse-starting edge, and the rise (activation) of the pulse outputted from the flip-flop SR-FFb forms a pulse-termination edge. Therefore, by constituting the shift register 104 to be capable of providing a sharp rise/fall (activation) of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus 1 is improved.

Figure 17:
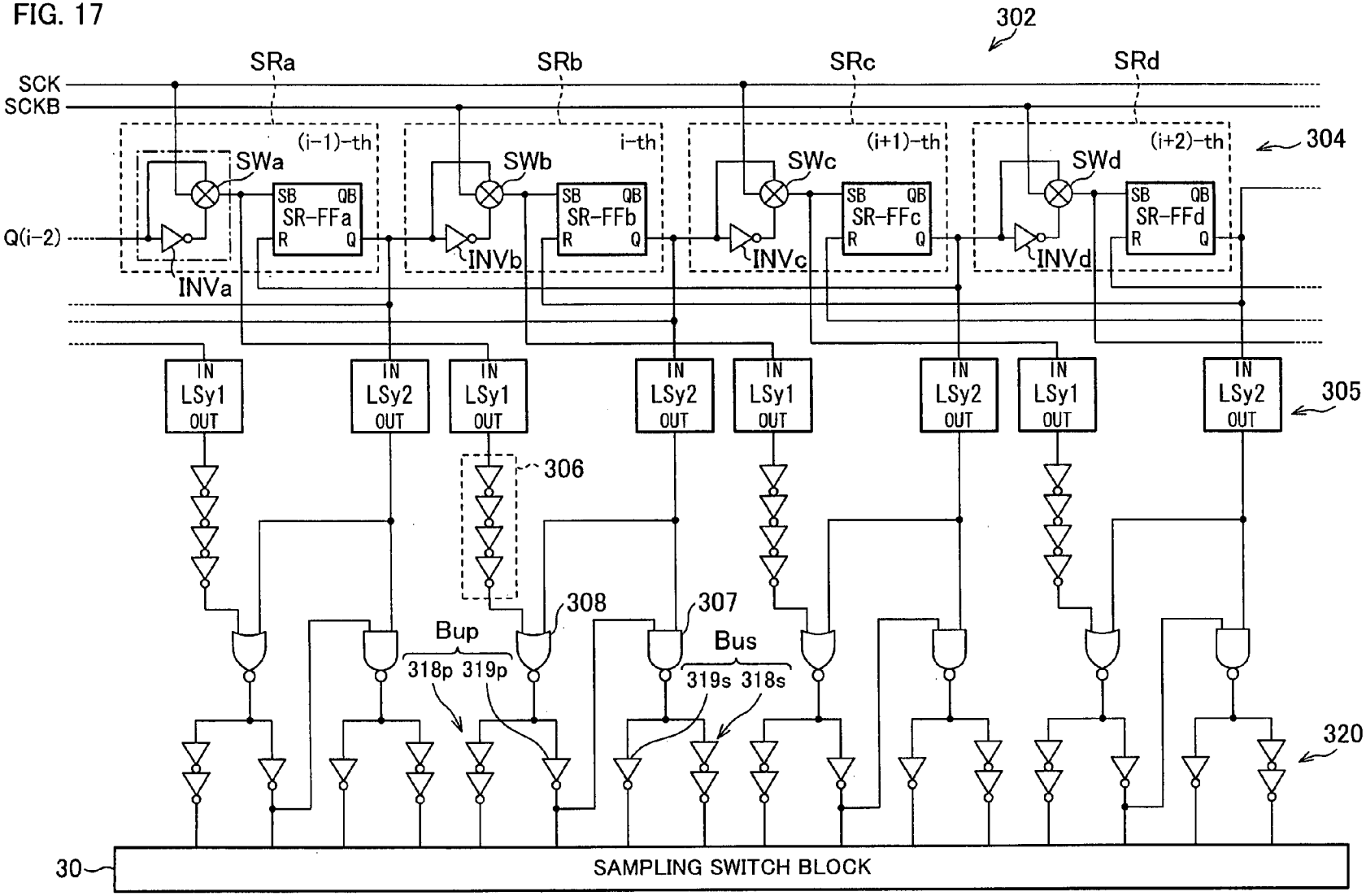
FIG. 17 A circuit diagram showing a structure of a source driver according to Fourth Embodiment.

Alternatively, the pulse processing circuit 305 may have the structure shown in FIG. 17, with the same layouts of the shift register 304 and the buffer 320. More specifically, corresponding to the shift register circuit SR, a single delay circuit, two level shifters, an NOR with two inputs and a NAND with two inputs are provided. For example, the pulse processing circuit 305 corresponding to the i-th shift register circuit SRb includes two level shifters LSy1 and LSy2 identical in structure to the level shifter LSy, a delay circuit 306, a NOR308 and a NAND307. The delay circuit 306 is constituted of a cascade four-stage inverter, and includes a single input terminal and a single output terminal. The IN terminal of the level shifter LSy1 is connected to the conduction terminal (in the output end) of the switch SWa (provided in the (i−1)-th shift register circuit SRa), and the OUT terminal of the level shifter LSy is connected to the input of the delay circuit 306. The output of the delay circuit 306 is connected to one of the inputs of the NOR308. The IN terminal of the level shifter LSy2 is connected to the output Q of the i-th flip-flop SR-FFb (provided in the shift register circuit SRb), and the OUT terminal of the level shifter LSy2 is connected to the other input of the NOR308 and one of the inputs of the NAND307. The output of the NOR308 is connected to the input of the inverter circuit 318P and the input of the inverter 319P. The output of the inverter 319P is connected to the other input of the NAND307, and the output of the NAND307 is connected to the input of the inverter circuit 318S and the input of the inverter 319S.

Also in this structure of FIG. 17, the pre-charge pulse (output pulse from the NOR308) is generated by the two source pulses, namely, the pulse outputted from the flip-flop SR-FFa, and the pulse outputted from the flip-flop SR-FFb. The fall (activation) of the pulse outputted from the flip-flop SR-FFa forms a pulse-starting edge, and the rise (activation) of the pulse outputted from the flip-flop SR-FFb forms a pulse-termination edge. Therefore, by constituting the shift register 304 to be capable of providing a sharp rise/fall (activation) of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus is improved.

Figure 18:
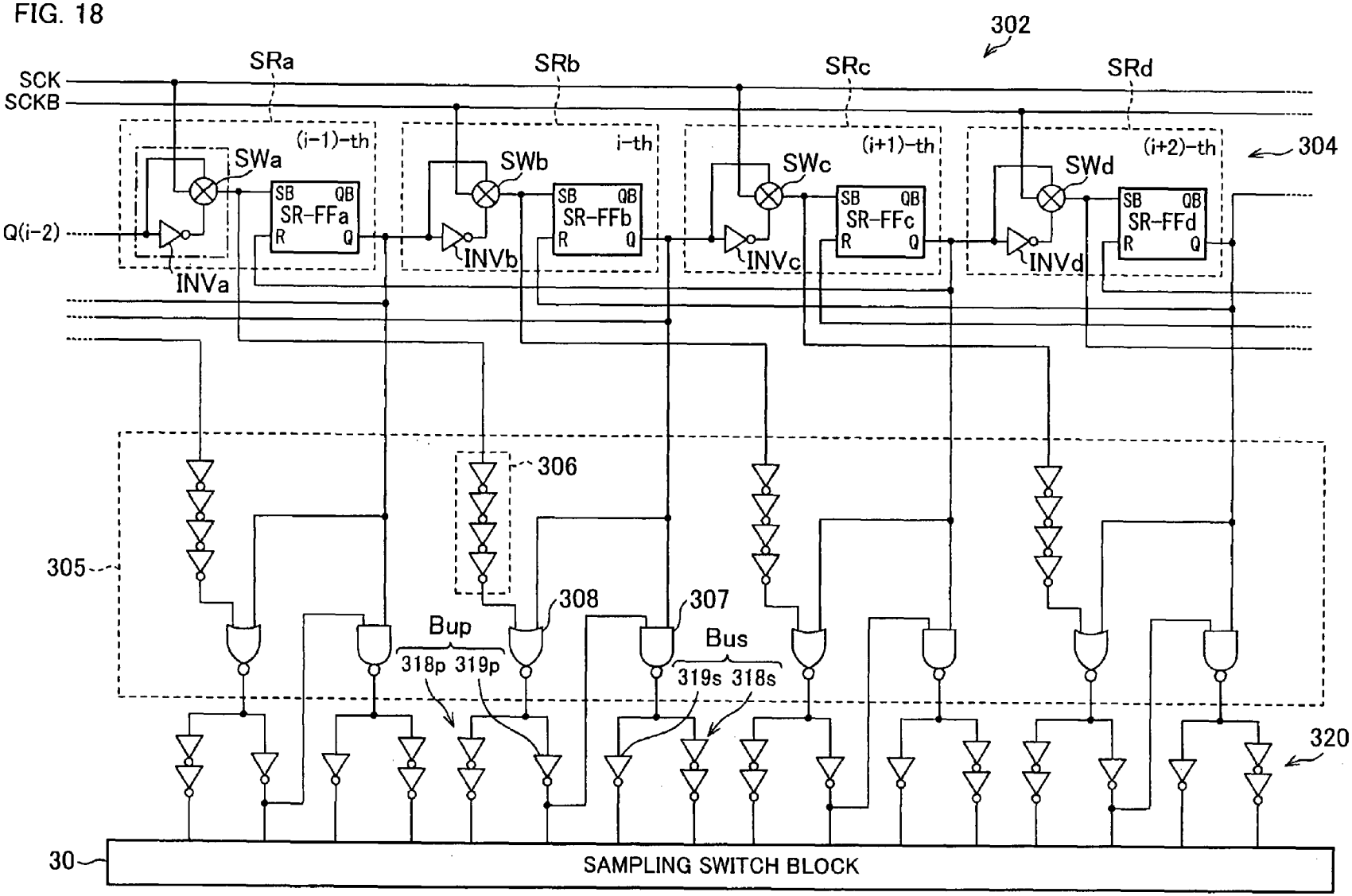
FIG. 18 A circuit diagram showing a structure of a source driver according to Fourth Embodiment.

Note that, in FIG. 17, the level shifter LSy1 and the level shifter LSy2 serve only to shift a potential level of the input pulse, and therefore the level shifters LSy1 and LSy2 may be omitted from the structure of FIG. 17. This structure is shown in FIG. 18.

Fifth Embodiment

Figure 19:
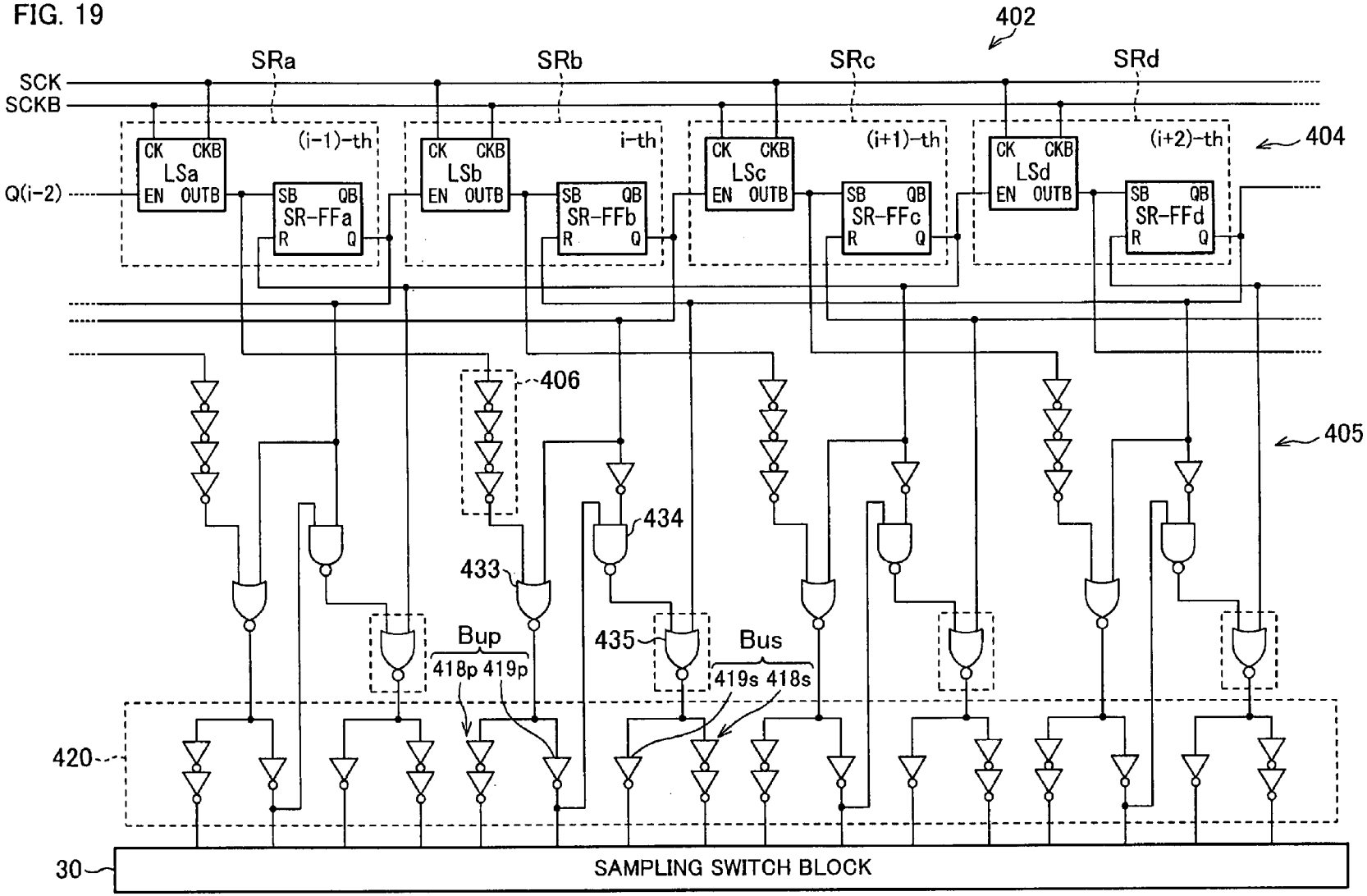
FIG. 19 A circuit diagram showing a structure of the source driver according to Fifth Embodiment.

FIG. 19 is a circuit diagram showing a structure of a source driver according to Fifth Embodiment of the present invention.

As shown in the figure, the source driver 402 includes a shift register 404, a pulse processing circuit 405, and a buffer 420. The shift register 404 includes a large number of shift register stages (circuits) SR. Among them, an (i−1)-th shift register circuit SRa, an i-th shift register circuit SRb, an (i+1)-th shift register circuit SRc, and an (i+2)-th shift register circuit SRd are discussed here. Each shift register circuit SR includes a flip-flop SR-FF and a level shifter LS. The level shifter LS serves to carry out level shift of clocks (CK and CKB), which are fetched when the EN terminal is active, and outputs the results through an OUTB. The flip-flop SR-FF is a set-reset type flip-flop having an input SB (set bar), a reset R, and outputs Q and QB.

The flip-flop SR-FF of each shift register circuit SR is connected to the OUTB of the level shifter LS in the same stage via its SB, and is also connected via R to the Q of the shift register circuit SR second adjacent to the right of the figure. The Q is connected to the EN terminal of the level shifter LS provided in the shift register circuit SR to the right.

The shift register circuit SRa includes a level shifter LSa and a flip-flop SR-FFa, the shift register circuit SRb includes a level shifter LSb and a flip-flop SR-FFb, the shift register circuit SRc includes a level shifter LSc and a flip-flop SR-FFc, and the shift register circuit SRd includes a level shifter LSd and a flip-flop SR-FFd.

Further, the pulse processing circuit 405 includes two delay circuits, two level shifters, and a NOR (two inputs) and a NAND (two inputs) corresponding to each shift register circuit SR. The buffer 420 includes a pre-charge buffer circuit BuP and a sampling buffer circuit BuS corresponding to each shift register circuit SR. The pre-charge buffer circuit BuP outputs a pre-charge pulse, and the sampling buffer circuit BuS outputs a sampling pulse. Note that, the NAND is a general circuit for outputting a result of logical multiplication, and serves to output "No". In this embodiment, the polarity of the output is determined for the sake of convenience.

In the source driver 402 according to the present embodiment, a pulse processing circuit 405 of an i-th shift register circuit SR includes a level shifter LSx, a level shifter LSy, delay circuits 406 and 409, and two NORs 433 and 435, and a NAND434. The delay circuit 406 is constituted of a cascade four-stage inverter, and the delay circuit 409 is constituted of a cascade two-stage inverter. These two delay circuits each include a single input terminal and a single output terminal. Further, corresponding to each i-th shift register circuit SRb, the buffer 420 includes an inverter circuit 418P and an inverter 419P serving as a pre-charge buffer circuit BuS, and an inverter circuit 418S and an inverter 419S serving as a sampling buffer BuS. The inverter circuits 418P and 418S are each constituted of a cascade two-stage inverter having a single input terminal and a single output terminal.

The input of the delay circuit 406 is connected to the OUTB of the level shifter LSa (provided in the (i−1)-th shift register circuit SRa), and the output of the delay circuit 406 is connected to one of the inputs of the NOR433. The output Q of the i-th flip-flop SR-FFb (provided in the shift register circuit SRb) is connected to another input of the NOR433 and one of the inputs of the NAND434. The output of the NOR433 is connected to the input of the inverter circuit 418P and the input of the inverter 419P. Further, the output of the inverter 419P is connected to one of the inputs of the NAND434, and the output of the NAND434 is connected to one of the inputs of the NAND435. The other input of the NAND435 is connected to the output Q of the flip-flop SR-FFd (provided in the (i+2)-th shift register circuit SRd), and the output (of the NOR435) is connected to the input of the inverter circuit 418S and the input of the inverter 419S.

Figure 2:
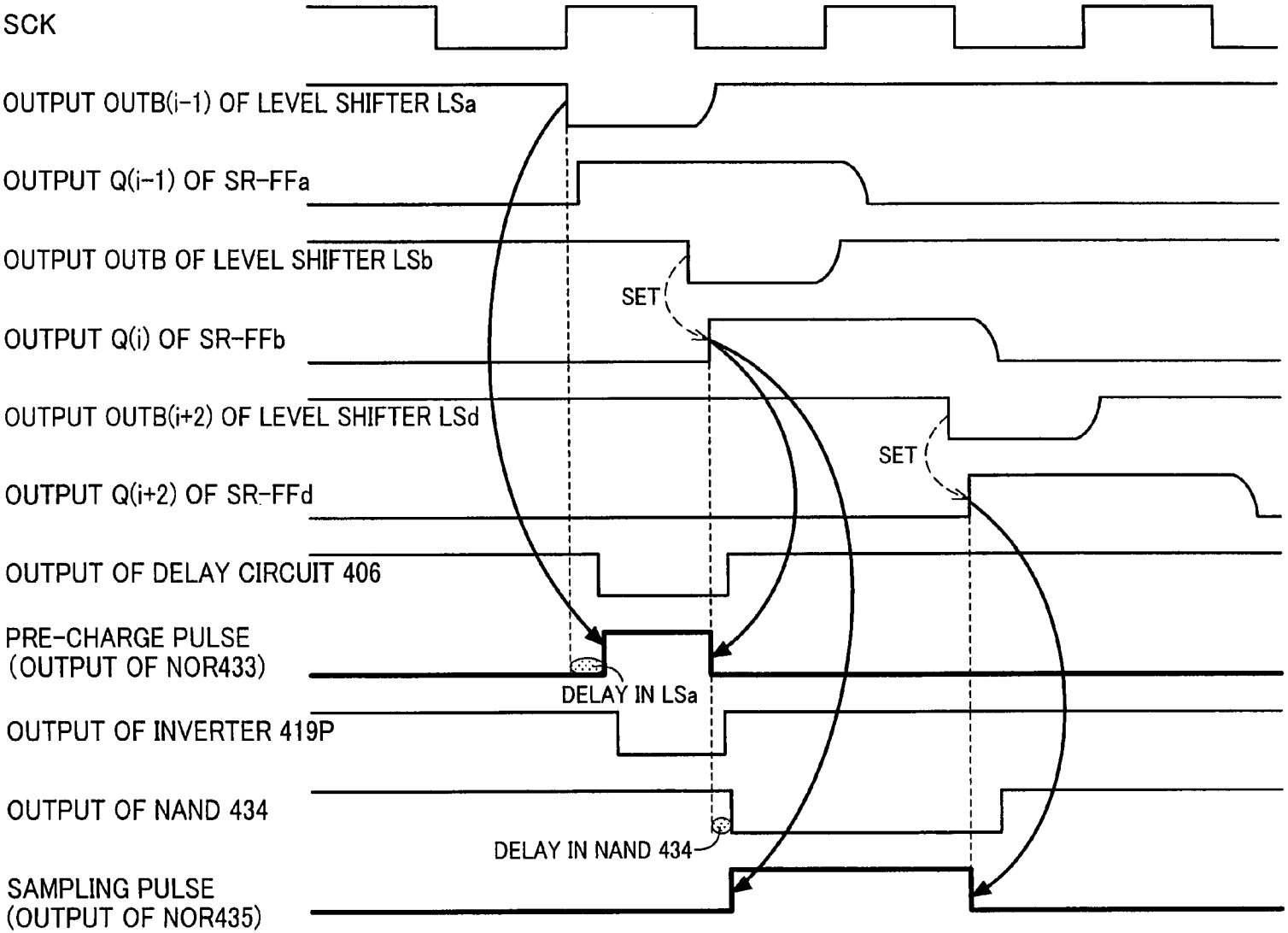
FIG. 2 A timing chart showing an operation of a source driver according to Fifth Embodiment.

The following explains an operation of the source driver shown in FIG. 19, with reference to FIG. 2.

First, when the SCK becomes "L" at t1, the output terminal OUTB of the level shifter LSa becomes "L(active)" (falls). When the output terminal OUTB of the level shifter LSa becomes "L(active)", the output of the delay circuit 406 also becomes "L(active)" (falls) with a delay. The delay is caused by the delay circuit 406. When the output of the delay circuit 406 becomes "L(active)", one of the inputs of the NOR433 becomes "L", and the output of the NOR433 becomes "H(active)" (rises) with a delay. At this time, the NOR433 starts outputting the pre-charge pulse. In this manner, the output pulse of the level shifter LSa serves as a source pulse for generating a pre-charge pulse (for forming a pulse-starting edge).

Next, when the output Q of the SR-FFb becomes "H(active)" at t2, one of the inputs of the NOR433 becomes "H", and the NOR433 outputs "L". At this time, the NOR433 finishes the output of pre-charge pulse. In this manner, the output pulse Q(i) of the flip-flop SR-FFb serves as a source pulse for generating a pre-charge pulse (for forming a pulse-termination edge).

When the output of the NOR433 becomes "L" again, the output of the inverter circuit 419 becomes "H" again. In response to this, the output of the NAND434 becomes "L(active)" with a delay. Consequently, the two inputs of the NOR435 (the other input is the output Q of the flip-flop SR-FFd) become "L", and the output of the NOR435 becomes "H (active)". At this time, the NOR435 starts outputting the sampling pulse. The provision of the NAND434 thus keeps an interval between the pre-charge pulse and the sampling pulse.

Next, when the output Q of the flip-flop SR-FFd becomes "H" at t3, one of the inputs of the NOR435 becomes "H", and the output of the NOR435 becomes "L". At this time, the NOR435 finishes the output of sampling pulse.

According to Fifth Embodiment, the pre-charge pulse (output pulse from the NOR433) is generated by the two source pulses, namely, the pulse outputted from the level shifter LSa, and the pulse outputted from the flip-flop SR-FFb. The fall (activation) of the pulse outputted from the level shifter LSa forms a pulse-starting edge, and the rise (activation) of the pulse outputted from the flip-flop SR-FFb forms a pulse-termination edge. Therefore, by providing a sharp rise or fall of pulse in response to activation of the source pulses (that is, the return pulse is blunt), the pulse width of the pre-charge pulse can be highly-accurately set. In this way, the problem of a decrease in pre-charge period due to uneven transistor characteristic, or inadequate timing of pre-charge can be solved. On this account, display quality of the display apparatus 1 is improved.

Figure 20:
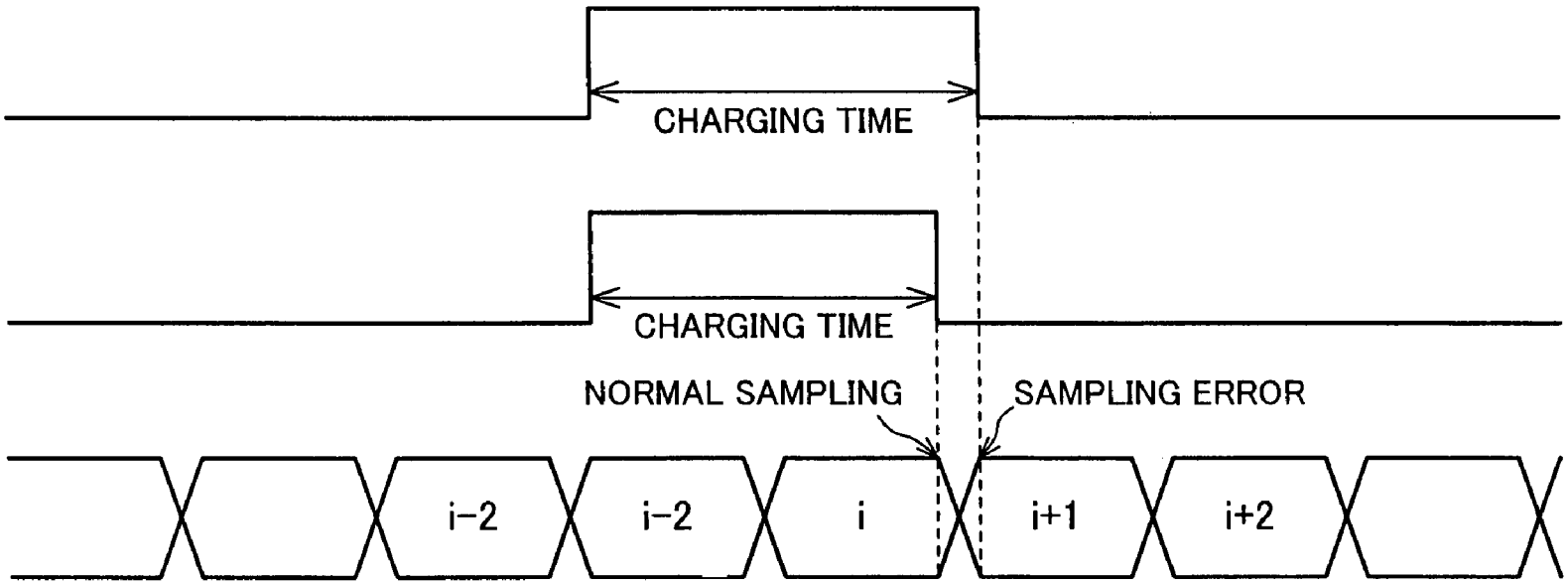
FIG. 20 A timing chart for showing an effect of the source driver of FIG. 19.
Figure 21:
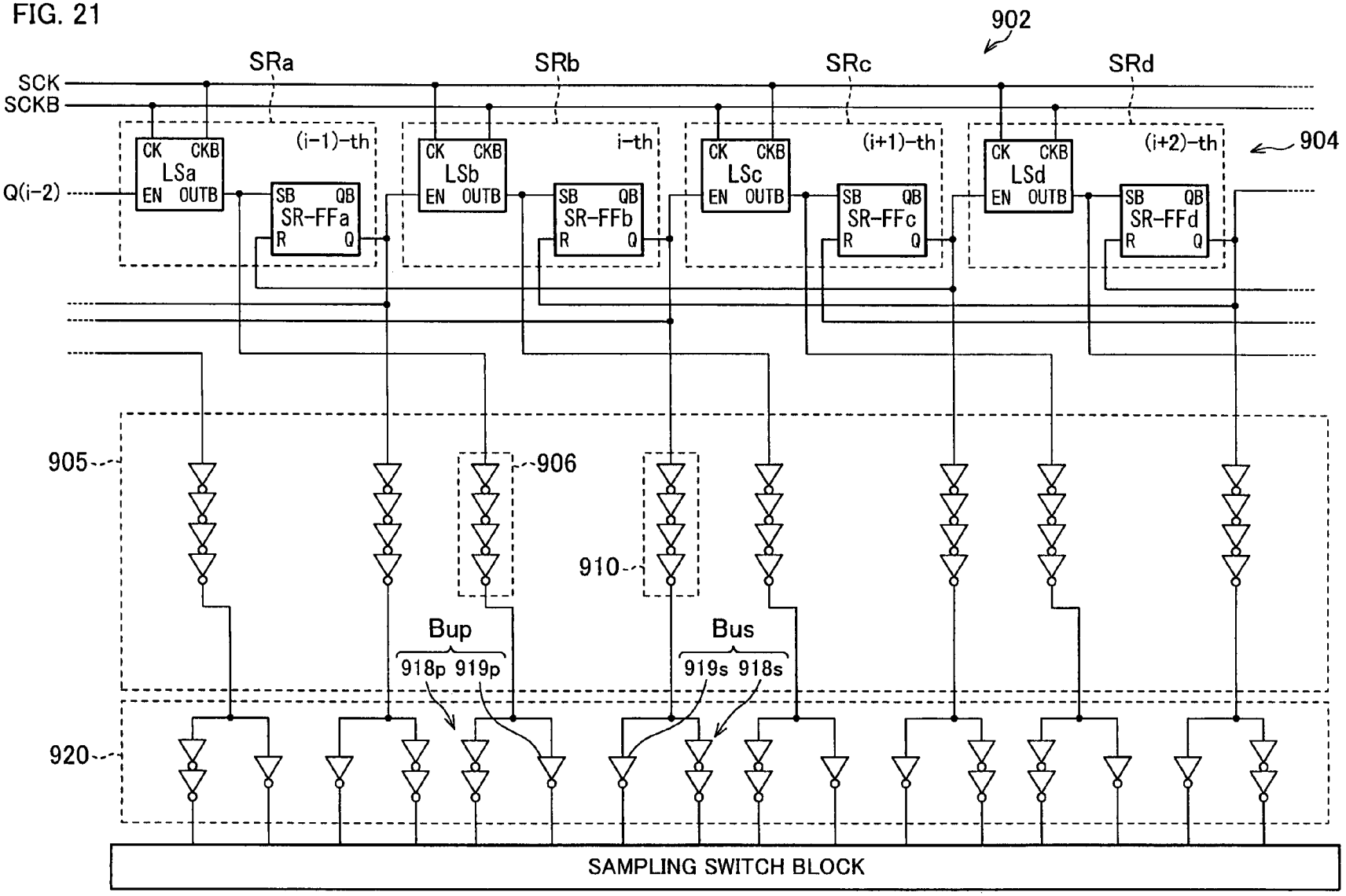
FIG. 21 A circuit diagram showing a structure of a conventional source driver.
Figure 22:
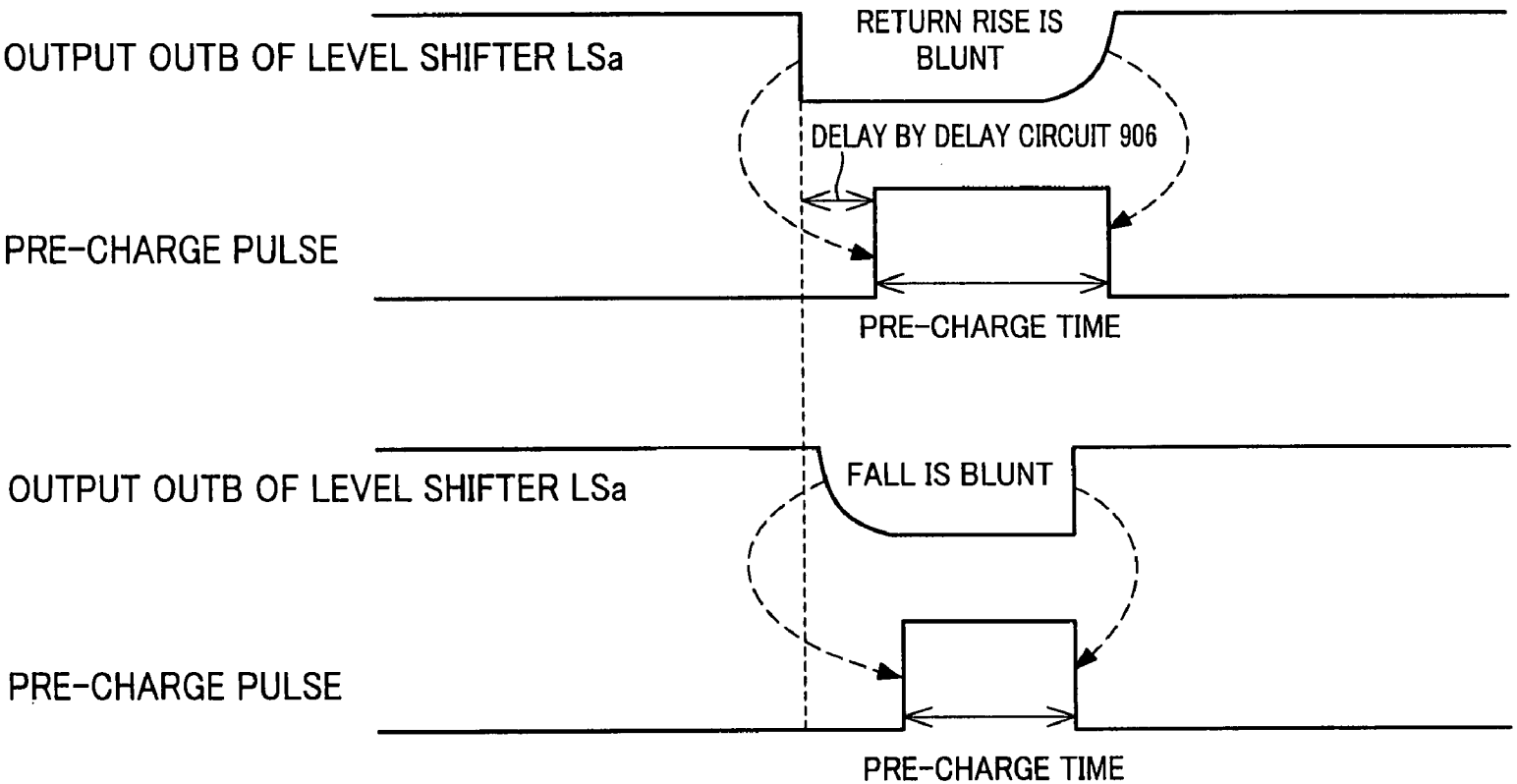
FIG. 22 A timing chart for showing a problem of the conventional source driver.

Further, according to the present embodiment, the sampling pulse (output pulse from the NOR435) is generated by the two source pulses, namely, the pulse outputted from the flip-flop SR-FFb, and the pulse outputted from the flip-flop SR-FFd. The fall (activation) of the pulse outputted from the flip-flop SR-FFb forms a pulse-starting edge, and the rise (activation) of the pulse outputted from the flip-flop SR-FFd forms a pulse-termination edge. Therefore, by providing a sharp rise or fall of pulse in response to activation of the source pulses (that is, the return pulse is blunt), the pulse width of the sampling pulse can be highly-accurately set. On this account, it becomes possible to prevent a problem of sampling error (pickup of next data; see the upper part of FIG. 20) due to a delay or wrong timing of sampling pulse (as a result, the sampling period is increased) which is caused by uneven transistor characteristic. Consequently, the display quality of the display apparatus 1 improves By thus designing the delay circuits 406 and 9 so that the pulse-starting edge and the pulse-termination edge of the sampling pulse are formed at rapid timings (or deleted if not required), the width of the sampling pulse (sampling period) can be set to a desired length with high accuracy.

Note that, the NOR435 is a general circuit for outputting a result of logical multiplication, and serves to output "No". In this embodiment, the polarity of the output is determined for the sake of convenience. Further, depending on the polarity combination of input signals supplied to the logic circuit, the NOR435 may be replaced with a circuit for outputting a result of logic addition.

As described, with the present embodiment, an excessive reduction in sampling pulse width due to uneven transistor characteristic can be prevented, and a pulse in which the pre-charge pulse and the sampling pulse are not superimposed can be easily generated. Further, an excessive reduction in pre-charge pulse width due to uneven transistor characteristic can be prevented, and a pulse in which the i-th pre-charge pulse and the (i+1)-th pre-charge pulse are not superimposed can be easily generated. Moreover, with addition of a delay elimination circuit (NOR435), the present embodiment eliminates an excessive delay of the pulse-termination edge of sampling pulse. On this account, false operation in sampling can be prevented.

The following explains a part of reference numerals.

1: display apparatus
2, 102, 202, 302, 402: source driver
4, 104, 204. 304, 404: shift register
5, 105, 205, 305, 405: signal generation circuit
6, 106, 206, 306, 406: delay circuit
7, 107, 207, 307, 434: NAND
20, 120, 220, 320, 420: signal generation circuit
SR-FF (SR-type): flip-flop
SRa to SRd: shift register circuit
LSa to LSd: level shifter
LSx and LSy: level shifter
BuP, BuS: buffer circuit
30: sampling switch block

INDUSTRIAL APPLICABILITY

The drive circuit (source driver) of a display apparatus according to the present invention is applicable to various purposes, such as a display panel for a mobile device, or a display apparatus including TVs and monitors.

The invention claimed is:

1. A drive circuit for a display apparatus, comprising:

a shift register; and a pulse generation circuit for generating a drive pulse signal using an output pulse signal generated in the shift register, wherein the pulse generation circuit forms a pulse-starting edge and a pulse-termination edge of the drive pulse signal using a rise or a fall of pulse resulting from activation of the output pulse signal, the shift register is structured to generate pulses so that a rise of a pulse resulting from activation of the output pulse signal is sharper than a return fall of the pulse, or a fall of the pulse resulting from activation of the output pulse signal is sharper than a return rise of the pulse, the pulse-starting edge of the drive pulse signal is formed of a rise or a fall of a pulse resulting from activation of a first output pulse signal, and the pulse-termination edge of the drive pulse signal is formed of a rise or a fall of a pulse resulting from activation of a second output pulse signal.

2. The drive circuit for a display apparatus as set forth in claim 1, wherein the drive pulse signal is generated for each stage of the shift register, the first output pulse signal forming the pulse-starting edge of the drive pulse signal for a given stage is generated within the same stage or a preceding stage, and the second output pulse signal forming the pulse-termination edge of the drive pulse signal for a given stage is generated within the same stage or a later stage.

3. The drive circuit for a display apparatus as set forth in claim 2, wherein the drive pulse signal is a pre-charge pulse signal, and the first output pulse signal forming the pulse-starting edge of the pre-charge pulse signal is generated in a stage preceding to the given stage, and the second output pulse signal forming the pulse-starting edge of the pre-charge pulse signal is generated within the same stage.

4. The drive circuit for a display apparatus as set forth in claim 2, wherein the drive pulse signal is a sampling pulse signal, and the first output pulse signal forming the pulse-starting edge of the sampling pulse signal is generated within the same stage, and the second output pulse signal forming the pulse-starting edge of the sampling pulse signal is generated in a stage later than the given stage.

5. The drive circuit for a display apparatus as set forth in claim 1, wherein the pulse generation circuit includes a level shifter having an input terminal and a control terminal, when the control terminal has a first potential, the level shifter carries out level shift of a pulse signal fetched through the input terminal before outputting the pulse signal, and when the control terminal has a second potential, the level shifter outputs a signal of a certain potential, the first output pulse signal is supplied to the input terminal and the second output pulse signal is supplied to the control terminal.

6. The drive circuit for a display apparatus as set forth in claim 5, wherein the first and second output pulse signals are respectively supplied to the input terminal and the control terminal via a level shift circuit which carries out level shift of a signal supplied thereto before outputting the signal.

7. The drive circuit for a display apparatus as set forth in claim 5, wherein the first and second output pulse signals are respectively supplied to the input terminal and the control terminal via a delay circuit.

8. The drive circuit for a display apparatus as set forth in claim 1, wherein the pulse generation circuit includes a logic circuit, and the first and second output pulse signals are supplied to the logic circuit.

9. The drive circuit for a display apparatus as set forth in claim 8, wherein the first and second output pulse signals are supplied to the logic circuit via respective level shift circuits which carry out level shift of signals supplied thereto before outputting the signals.

10. The drive circuit for a display apparatus as set forth in claim 8, wherein the first and second output pulse signals are respectively supplied to the logic circuit via a delay circuit.

11. A display apparatus comprising the drive circuit for a display apparatus as set forth in claim 1.

12. A drive circuit for a display apparatus, comprising:

a shift register;

a pre-charge pulse generation circuit for generating a pre-charge pulse signal using an output pulse signal generated in the shift register; and a sampling pulse generation circuit for generating a sampling pulse signal using an output pulse signal generated in the shift register, wherein: the pre-charge pulse generation circuit forms a pulse-starting edge and a pulse-termination edge of the pre-charge pulse signal using a rise or a fall of pulse resulting from activation of the output pulse signal, and the sampling pulse generation circuit forms a pulse-starting edge and a pulse-termination edge of the sampling pulse signal using a rise or a fall of pulse resulting from activation of the output pulse signal, the shift register is structured to generate pulses so that a rise of a pulse resulting from activation of the output pulse signal is sharper than a return fall of the pulse, or a fall of the pulse resulting from activation of the output pulse signal is sharper than a return rise of the pulse, the pre-charge pulse signal is generated from two output pulse signals, one of which forms the pulse-starting edge of the pre-charge pulse signal while the other forms the pulse-termination edge of the pre-charge pulse signal, and the sampling pulse signal is also generated from two output pulse signals, one of which forms the pulse-starting edge of the sampling pulse signal while the other forms the pulse-termination edge of the sampling pulse signal.

13. The drive circuit for a display apparatus as set forth in claim 12, wherein the pre-charge pulse generation circuit includes either a logic circuit, or a level shifter, the level shifter carrying out level shift of a pulse signal fetched through an input terminal before outputting the pulse signal when a control terminal has a first potential, and outputting a signal of a certain potential when the control terminal has a second potential, the sampling pulse generation circuit includes either a logic circuit, or a level shifter, the level shifter carrying out level shift of a pulse signal fetched through an input terminal before outputting the pulse signal when a control terminal has a first potential, and outputting a signal of a certain potential when the control terminal has a second potential.

14. The drive circuit for a display apparatus as set forth in claim 12, wherein the pre-charge pulse signal and the sampling pulse signal are generated for each stage of the shift register, the output pulse signal forming the pulse-starting edge of the pre-charge pulse signal for a given stage is generated in a stage preceding to the given stage, and the output pulse signal forming the pulse-termination edge of the pre-charge pulse signal for a given stage is generated within the same stage, the output pulse signal forming the pulse-starting edge of the sampling pulse signal for a given stage is generated within the same stage, and the output pulse signal forming the pulse-termination edge of the sampling pulse signal for a given stage is generated in a stage later than the given stage.

15. The drive circuit for a display apparatus as set forth in claim 14, wherein the pre-charge pulse generation circuit includes a first NOR circuit supplied with an output pulse signal generated in a stage preceding to the given stage and an output pulse signal generated in the given stage, the sampling pulse generation circuit includes (i) a NAND circuit supplied with an inversion pulse signal of an output of the first NOR circuit and an output pulse signal generated in the given stage, and (ii) a second NOR circuit supplied with an output of the NAND circuit and an output pulse signal generated in a stage later than the given stage.

16. A drive circuit for a display apparatus comprising:

a shift register; and a pulse generation circuit for generating a drive pulse signal using an output pulse signal from the shift register, wherein the pulse generation circuit forms a pulse-starting edge and a pulse-termination edge of the drive pulse signal using a return fall of a risen pulse resulted from activation of the output pulse signal or a return rise of a fallen pulse resulted from activation of the output pulse signal, the shift register is structured to generate pulses so that a rise of a pulse resulting from activation of the output pulse signal is blunter than a return fall of the pulse, or a fall of the pulse resulting from activation of the output pulse signal is blunter than a return rise of the pulse, the pulse-starting edge of the drive pulse signal is formed of a return fall following a rise of a pulse resulting from activation of a first output pulse signal or formed of a return rise following a fall of the pulse resulting from activation of the first output pulse signal, and the pulse-termination edge of the drive pulse signal is formed of a return fall following a rise of a pulse resulting from activation of a second output pulse signal or formed of a return rise following a fall of the pulse resulting from activation of the second output pulse signal.

17. A drive circuit for a display apparatus comprising:

a shift register of plural stages, for driving a display apparatus which carries out writing of data into a data signal line and pre-charging of a predetermined data signal line at a stage later than said data signal line, wherein each stage of the shift register outputs a pulse signal, the shift register generates a rise of a pre-charge pulse for pre-charging an n-th data signal line which corresponds to an n-th stage of the shift register, in response to a fall of a pulse signal outputted from a stage preceding to the n-th stage of the shift register as a result of activation of the pulse signal, and generates a return fall of the pre-charge pulse in response to a rise of a pulse signal outputted from the n-th stage of the shift register as a result of activation of the pulse signal, the shift register is structured to generate pulses so that a rise of a pulse resulting from activation of the output pulse signal is blunter than a return fall of the pre-charge pulse, or a fall of the pulse resulting from activation of the output pulse signal is blunter than a return rise of the pre-charge pulse, a pulse-starting edge of the pre-charge pulse is formed of a return fall following a rise of a pulse resulting from activation of a first output pulse signal or formed of a return rise following a fall of the pulse resulting from activation of the first output pulse signal, and a pulse-termination edge of the pre-charge pulse is formed of a return fall following a rise of a pulse resulting from activation of a second output pulse signal or formed of a return rise following a fall of the pulse resulting from activation of the second output pulse signal.

18. The drive circuit for a display apparatus as set forth in claim 17, wherein the drive circuit generates a rise of a sampling pulse for writing data into an n-th data signal line, in response to the return fall of the pre-charge pulse.

19. A pulse generation method for generating a drive pulse signal using an output pulse signal generated in a shift register, wherein a pulse-starting edge and a pulse-termination edge of the drive pulse signal are formed of a rise or a fall of pulse resulting from activation of the output pulse signal, and when a rise of a pulse resulting from activation of the output pulse signal is sharper than a return fall of the pulse or when a fall of the pulse resulting from activation of the output pulse signal is sharper than a return rise of the pulse, a pulse-starting edge of the drive pulse signal is formed of a rise or a fall of a pulse resulting from activation of a first output pulse signal, and a pulse-termination edge of the drive pulse signal is formed of a rise or a fall of a pulse resulting from activation of a second output pulse signal.

* * * * *